US011127387B2

(12) United States Patent
Kusumoto et al.

(10) Patent No.: US 11,127,387 B2
(45) Date of Patent: Sep. 21, 2021

(54) SOUND SOURCE FOR ELECTRONIC PERCUSSION INSTRUMENT AND SOUND PRODUCTION CONTROL METHOD THEREOF

(71) Applicant: Roland Corporation, Shizuoka (JP)

(72) Inventors: Yoshinori Kusumoto, Shizuoka (JP); Yusuke Tanakadate, Shizuoka (JP); Masato Katsuda, Shizuoka (JP)

(73) Assignee: Roland Corporation, Shizuoka (JP)

( * ) Notice: Subject to any disclaimer, the term of this patent is extended or adjusted under 35 U.S.C. 154(b) by 428 days.

(21) Appl. No.: 16/334,357

(22) PCT Filed: Jul. 20, 2017

(86) PCT No.: PCT/JP2017/026173
§ 371 (c)(1),
(2) Date: Mar. 19, 2019

(87) PCT Pub. No.: WO2018/055892
PCT Pub. Date: Mar. 29, 2018

(65) Prior Publication Data

US 2021/0201880 A1 Jul. 1, 2021

(30) Foreign Application Priority Data

Sep. 21, 2016 (JP) ..... JP2016-183637

(51) Int. Cl.
*G10H 7/08* (2006.01)
*G10H 1/00* (2006.01)

(52) U.S. Cl.
CPC ..... *G10H 7/08* (2013.01); *G10H 1/00* (2013.01); *G10H 2210/066* (2013.01); *G10H 2240/005* (2013.01)

(58) Field of Classification Search
CPC ..... G10H 7/08; G10H 1/00; G10H 2210/066; G10H 2240/005
See application file for complete search history.

(56) References Cited

U.S. PATENT DOCUMENTS 5,029,509 A 7/1991 Serra et al.
5,536,902 A 7/1996 Serra et al.
(Continued)

FOREIGN PATENT DOCUMENTS

JP H01310396 12/1989
JP H0535278 2/1993
(Continued)

OTHER PUBLICATIONS

NPL_371_1 Search Results, Jul. 16, 2021, 1 pp. (Year: 2021).*
(Continued)

*Primary Examiner* — Jianchun Qin
(74) *Attorney, Agent, or Firm* — JCIPRNET

(57) ABSTRACT

A sound source for an electronic percussion instrument and sound production control method thereof are provided. An electronic drum sound source device performs a weighting operation on four pieces of waveform information (pitch envelope, amplitude envelope, start phase) stored in a waveform table according to the beating conditions (hitting point position, velocity) based on the output from a struck sensor of an electronic drum pad. The electronic drum sound source device creates a sine wave on the basis of the waveform information whereon the weighting operation was performed, and generates musical sounds (sounds of percussion instrument) by synthesizing the sine wave with the waveforms of residual waveform data whereon the weighting operation was performed. The sine wave is not synthesized
(Continued)

with waveform data other than the residual waveform data, and thus consistent musical sounds with no phase interference can be reproduced.

20 Claims, 10 Drawing Sheets

(56) References Cited

U.S. PATENT DOCUMENTS

| | | | | |
|---|---|---|---|---|
| 5,563,361 | A * | 10/1996 | Kondo | G10H 1/383 84/613 |
| 5,936,182 | A | 8/1999 | Izumisawa | |
| 7,117,154 | B2 * | 10/2006 | Yoshioka | G10L 19/18 704/258 |
| 2012/0046771 | A1 * | 2/2012 | Abe | G10H 1/16 700/94 |
| 2013/0180386 | A1 * | 7/2013 | Susami | G10H 1/0008 84/621 |

FOREIGN PATENT DOCUMENTS

| | | |
|---|---|---|
| JP | H05143071 | 6/1993 |
| JP | H0635460 | 2/1994 |
| JP | H07325583 | 12/1995 |
| JP | H1115473 | 1/1999 |

OTHER PUBLICATIONS

NPL_371_2 Search Results, Jul. 16, 2021, 1 pp. (Year: 2021).*

"International Search Report (Form PCT/ISA/210) of PCT/JP2017/026173," dated Oct. 17, 2017, with English translation thereof, pp. 1-2.

* cited by examiner

Waveform table 41c

| Velocity | Hitting point position AP1 (0 mm) | Hitting point position AP2 (75 mm) | Hitting point position AP3 (150 mm) |
|---|---|---|---|
| 127 | (SW1, RW1) | (SW2, RW2) | (SW3, RW3) |
| 70 | (SW4, RW4) | (SW5, RW5) | (SW6, RW6) |
| 40 | (SW7, RW7) | (SW8, RW8) | (SW9, RW9) |

Standard waveform table SW1~9

SW1a SW1b SW1c SW1d

| Frequency (Hz) | Pitch envelope data | Amplitude envelope data | Start phase data (rad) |
|---|---|---|---|
| 129 | P1 | A1 | 3.14 |
| 300 | P2 | A2 | 1.57 |
| 417 | P3 | A3 | 2.09 |
| 512 | P4 | A4 | 1.41 |
| 724 | P5 | A5 | 2.22 |
| 859 | P6 | A6 | 1.85 |

SW1 SW2 : SW9

FIG. 3(a)

Pitch envelope data P1

P11 P12

| Time (ms) | Pitch data (cent) |
|---|---|
| 0 | +50 |
| 5 | −20 |
| 20 | +8 |
| 35 | −2 |
| 55 | +1 |
| 80 | 0 |
| : | : |
| 3000 | 0 |

FIG. 3(b)

Amplitude envelope data A1

A11 A12

| Time (ms) | Amplitude level data (dB) |
|---|---|
| 0 | −20 |
| 8 | −30 |
| 30 | −35 |
| 60 | −40 |
| 95 | −45 |
| : | : |
| 3000 | −90 |

FIG. 3(c)

Selected waveform table 23c

23c1 23c2

| No. | Waveform memory | Weighting coefficient memory |
|---|---|---|
| 1 | (SW1, RW1) | 0.3 |
| 2 | (SW2, RW2) | 0.2 |
| 3 | (SW4, RW4) | 0.2 |
| 4 | (SW5, RW5) | 0.3 |

FIG. 7(a)

Weighted waveform table 23d

23d1 23d2 23d3 23d4

| Frequency (Hz) | Pitch envelope data | Amplitude envelope data | Start phase data (rad) |
|---|---|---|---|
| 129 | wP1 | wA1 | 2.29 |
| 300 | wP2 | wA2 | 5.11 |
| 417 | wP3 | wA3 | 3.26 |
| 512 | wP4 | wA4 | 4.23 |
| 724 | wP5 | wA5 | 0.47 |
| 859 | wP6 | wA6 | 6.01 |

FIG. 7(b)

Start phase calculation table 23e

23e1 23e2

| No. | Start phase memory (rad) | Weighting coefficient memory |
|---|---|---|
| 1 | 5.68 | 0.3 |
| 2 | 1.88 | 0.2 |
| 3 | 4.90 | 0.2 |
| 4 | 3.79 | 0.3 |

FIG. 7(c)

SOUND SOURCE FOR ELECTRONIC PERCUSSION INSTRUMENT AND SOUND PRODUCTION CONTROL METHOD THEREOF

CROSS-REFERENCE TO RELATED APPLICATION

This application is a 371 application of the international PCT application serial no. PCT/JP2017/026173, filed on Jul. 20, 2017, which claims the priority benefit of Japan application no. 2016-183637, filed on Sep. 21, 2016. The entirety of each of the above-mentioned patent applications is hereby incorporated by reference herein and made a part of this specification.

TECHNICAL FIELD

The present invention relates to a sound source used for an electronic percussion instrument. In particular, the present invention relates to a sound source for an electronic percussion instrument capable of reproducing consistent sounds of a percussion instrument with no phase interference while realizing a smooth change in volume and tone color in accordance with a change in beating conditions.

DESCRIPTION OF RELATED ART

In a conventional electronic percussion instrument, a plurality of pieces of waveform data in accordance with the dynamics in performance information (beating) are prepared and the waveform data to be output is switched in accordance with a velocity of the beating. When the velocity of beating is positioned between two pieces of waveform data among the plurality of pieces of waveform data, cross-fading for synthesizing the two pieces of waveform data is performed to generate sound.

PATENT DOCUMENTS

[Patent Literature 1] Japanese Patent Laid-Open Publication No. H06-35460

[Patent Literature 2] Japanese Patent Laid-Open Publication No. H05-35278

[Patent Literature 3] Japanese Patent Laid-Open Publication No. H11-15473

However, when two pieces of waveform data are synthesized in a cross-fade section in which two pieces of waveform data are mixed, there is a problem that they may cancel each other out due to mutual phase interference to generate so-called "sound thinning." In addition, when waveform data to be used is switched from a plurality of pieces of waveform data in accordance with the velocity of the beating, there is a problem in which the tone color of the sound may suddenly change at the switching point of the waveform data.

Patent Literature 1 discloses an electronic percussion instrument in which a performance starts by striking pads. In detail, an electronic percussion instrument is disclosed in which, for example, sounds when hitting a central portion of a cymbal and sounds when hitting an outer peripheral portion of the cymbal are stored in each pad, and by changing a volume balance between the two kinds of musical sound in accordance with the hitting points of beating, a tone color change can be realized in the same way as when actually hitting a cymbal. The electronic percussion instrument of Patent Literature 1 also has the aforementioned problem.

Patent Literature 2 discloses a method of synthesizing musical sounds using addition synthesis of sine waves. Patent Literature 3 discloses an electronic musical instrument in which a tone color is changed by controlling a mixing ratio and an attenuation amount of harmonic overtones in accordance with a pitch and a touch in an addition synthesis sound source of a pitched musical instrument such as a piano or a guitar. Although these are based on an addition synthesis of sine waves for every harmonic overtone, a pitched musical instrument that has a stable overtone frequency with respect to elapse of playing time is assumed so that control of temporal change in pitch is not considered. Therefore, this is insufficient for synthesizing sounds of a percussion instrument with a large temporal change in frequency.

SUMMARY

The present invention has been made to solve the above problems, and it is an object of the present invention to provide a sound source of an electronic percussion instrument which can reproduce consistent sounds of a percussion instrument with no phase interference and can create a smooth change in volume and tone color in accordance with a change in beating conditions.

Solution to Problem

In order to achieve this object, a sound source of an electronic percussion instrument of the present invention is a sound source used for an electronic percussion instrument including a struck surface and a struck sensor for detecting hits on the struck surface. The sound source includes a waveform data storage means for storing waveform data of musical sounds, and a sound generation control means for generating musical sounds by using the waveform data stored in the waveform data storage means in accordance with the results of detection by the struck sensor. The waveform data storage means has two or more pieces of waveform data which have different beating conditions from each other, one of the pieces of waveform data having, with respect to each beating condition, pitch envelope data and amplitude envelope data for one or a plurality of sine wave components separated from an original waveform of a musical sound, and a residual component of the original waveform from which the one or the plurality of sine wave components are separated. The sound generation control means generates a sine wave component based on the pitch envelope data and the amplitude envelope data of the two or more pieces of waveform data stored in the waveform data storage means in accordance with detection results of the struck sensor and synthesizes the sine wave component with the residual component to generate musical sounds.

According one of the embodiments of the disclosure, a sound production control method is provided. The method detects hits on a struck surface of an electronic percussion instrument and performs sound production control on a musical sound according to detecting result of the hits. The method includes storing two or more pieces of waveform data of musical sounds recorded from an percussion in different beating conditions, wherein with respect to each beating condition, one of the pieces of the stored waveform data comprises pitch envelope data and amplitude envelope data for one or a plurality of sine wave components separated from an original waveform of the recorded musical sound, and a residual component of the original waveform from which the one or the plurality of sine wave components are separated; generating a sine wave component based on the pitch envelope data and the amplitude envelope data of the two or more pieces of stored waveform data in accordance with detection results of the hit; and synthesizing the generated sine wave component with the residual component to generate musical sounds.

BRIEF DESCRIPTION OF THE DRAWINGS

FIG. 3(*a*) is a diagram schematically showing a standard waveform table, FIG. 3(*b*) is a diagram schematically showing pitch envelope data, and FIG. 3(*c*) is a diagram schematically showing amplitude envelope data.

FIG. 7(*a*) is a diagram schematically showing a selected waveform table, FIG. 7(*b*) is a diagram schematically showing a weighted waveform table, and FIG. 7(*c*) is a diagram schematically showing a start phase calculation table.

DESCRIPTION OF THE EMBODIMENTS

Figure 1A:
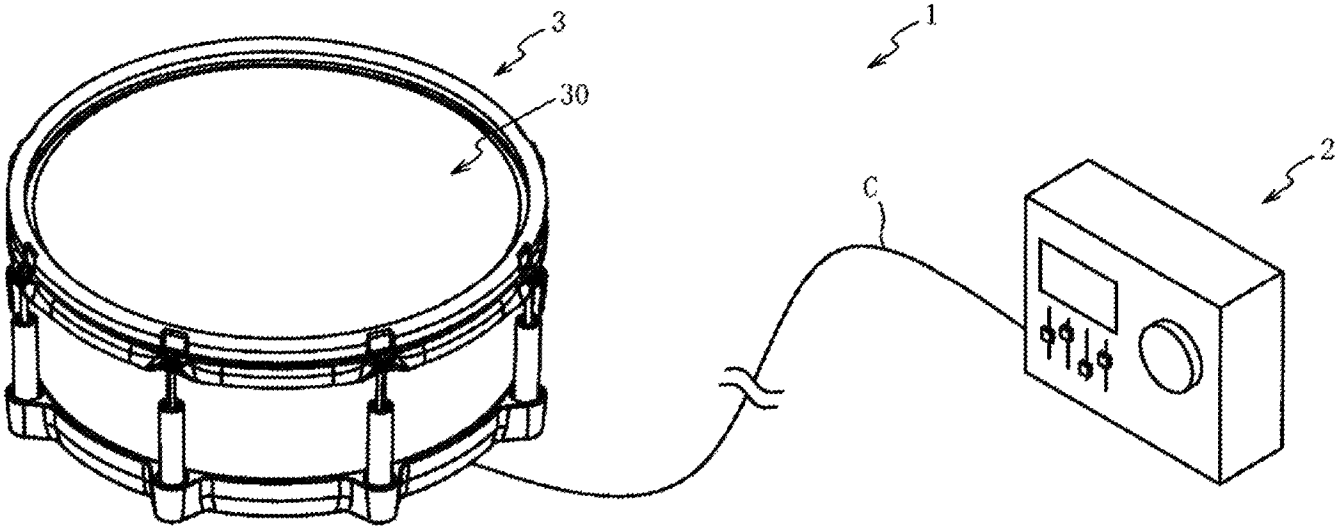
FIG. 1(*a*) is a diagram showing an electronic drum according to an embodiment of the present invention, and FIG. 1(*b*) is a front view of a personal computer (PC) for editing waveform information used in the electronic drum.
Figure 1B:
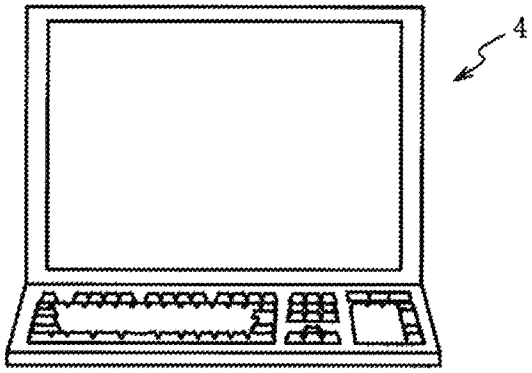

Hereinafter, preferred embodiments of the present invention will be described with reference to the accompanying drawings. In the present embodiment, an electronic drum 1 will be described, in which four pieces of waveform information approximating to velocities and hitting point positions with respect to an electronic drum pad 3 are selected from the waveform information obtained by sampling nine different performance sounds of a drum where the hitting strength (velocity) has three levels and the hitting point position (struck position) has three positions, a weighting operation is performed thereon and then musical sounds (sounds of a percussion instrument) are generated. First, with reference to FIGS. 1(*a*) and 1(*b*), an outline of an electronic drum 1 and a personal computer (hereinafter referred to as a PC) 4 for editing waveform information used by the electronic dram 1 for performance will be described. FIG. 1(*a*) is a diagram showing the electronic drum 1 which is an embodiment of the present invention. FIG. 1(*b*) is a front view of the PC 4 for editing waveform information used in the electronic drum 1.

The electronic drum 1 has an electronic drum sound source device 2 and an electronic drum pad 3. The electronic drum sound source device 2 and the electronic drum pad 3 are connected by a cable C. The electronic drum sound source device 2 is a device that generates musical sounds based on hits on the electronic drum pad 3 and outputs the generated musical sounds to a speaker 27 (see FIG. 6).

The electronic drum pad 3 is an electronic percussion instrument that transmits beating signals corresponding to the hits on a struck surface 30 of a user to the electronic drum sound source device 2. The electronic drum pad 3 has the struck surface 30 which receives hits of a user. When the struck surface 30 is hit by a user, a struck sensor 31 (see FIG. 6) disposed under the struck surface 30 detects the vibration of the struck surface 30 and the waveform of the vibration is transmitted via the cable C to a central processing unit (CPU) 20 (see FIG. 6) of the electronic drum sound source device 2. The CPU 20 detects a hitting velocity and a hitting point position from the waveform of the vibration, selects a plurality of pieces of waveform information approximating to the velocity and the hitting point position, synthesizes them by performing a weighting operation on them, and generates (outputs) a sound as a musical sound.

The PC 4 is an information processing device for editing waveform information used by the electronic drum 1 for performance. As will be described in detail later, the PC 4 executes standard waveform generation processing (see FIG. 4) to extract a "noticeable" frequency band, due to a change in frequency spectrum, of waveform data actually recorded from the drum stored in waveform data 41*b* (see FIGS. 2(*a*) and 2(*b*)). Then, in the frequency band, the PC 4 calculates a "pitch envelope" which represents a temporal change of the pitch for each frequency, an "amplitude envelope" which represents a temporal change of the amplitude for each frequency, and a "start phase" which represents a phase of waveform at the time of beginning for each frequency. Then, the PC 4 calculates a "residual waveform" which is a waveform having frequency components other than the "noticeable" frequency band.

The calculated pitch envelope, amplitude envelope, and start phase are stored in an area corresponding to the velocity and hitting point position of the recorded waveform data in a waveform table 41*c*. The waveform table 41*c* is transmitted to the electronic drum sound source device 2 via an external input/output terminal 48 (see FIGS. 2(*a*) and 2(*b*)) of the PC 4 and an external input/output terminal 24 (see FIG. 6) of the electronic drum sound source device 2 and is stored in a waveform table 22*a* (see FIG. 6) of a flash memory 22 of the electronic drum sound source device 2.

Figures 2A, 2B:
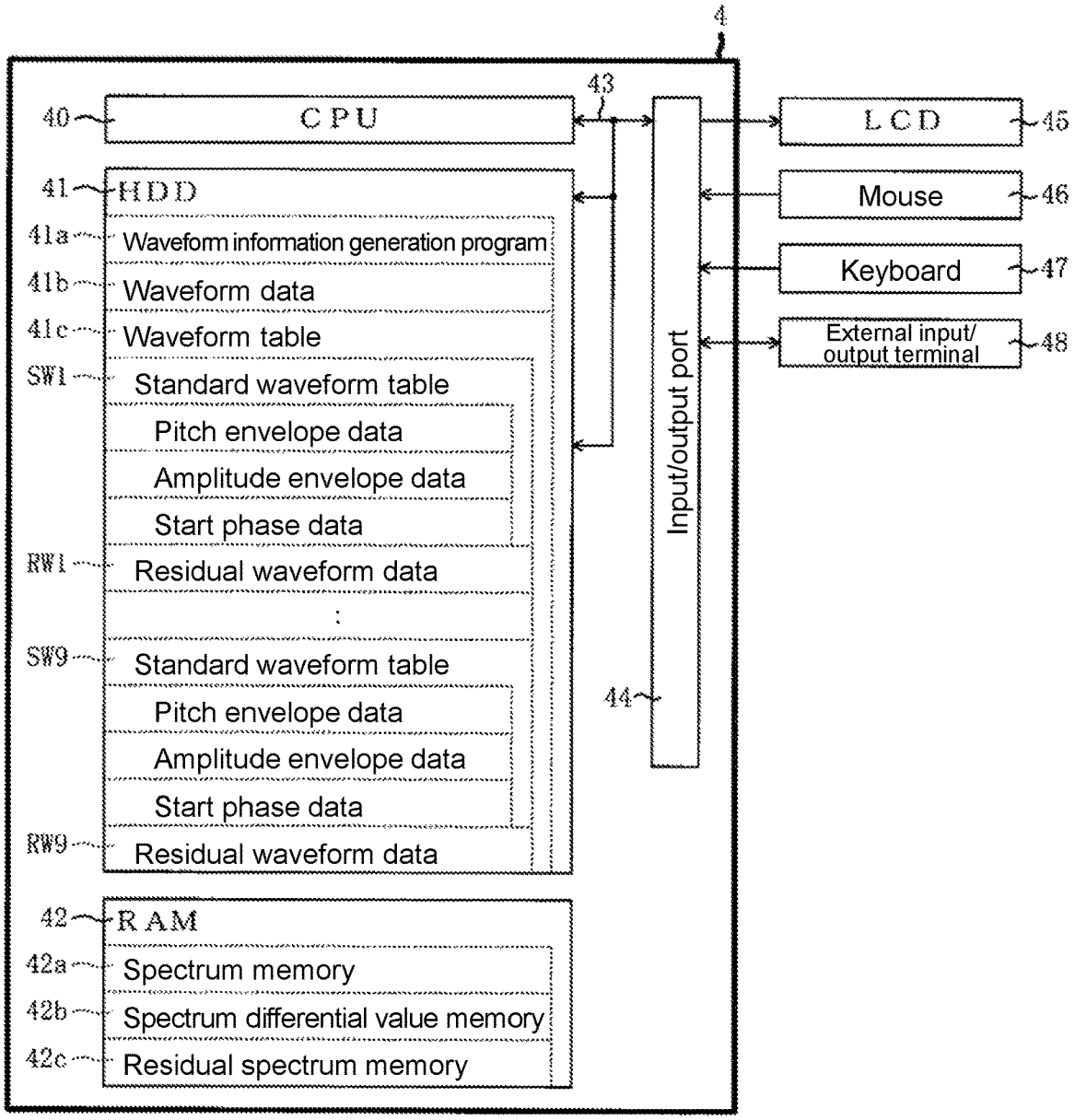
FIG. 2(*a*) is a block diagram showing an electrical configuration of the PC, and FIG. 2(*b*) is a diagram schematically showing a waveform table.

Next, with reference to FIGS. 2(*a*) and 2(*b*), an electrical configuration of the PC 4 will be described. FIG. 2(*a*) is a block diagram showing the electrical configuration of the PC 4. The PC 4 includes a CPU 40, a hard disk drive (hereinafter referred to as an "HDD") 41, and a random access memory (RAM) 42, which are connected to an input/output port 44 via a bus line 43. Also, a liquid crystal display (LCD) 45, a mouse 46, a keyboard 47 and the external input/output terminal 48 are connected to the input/output port 44.

Figure 4:
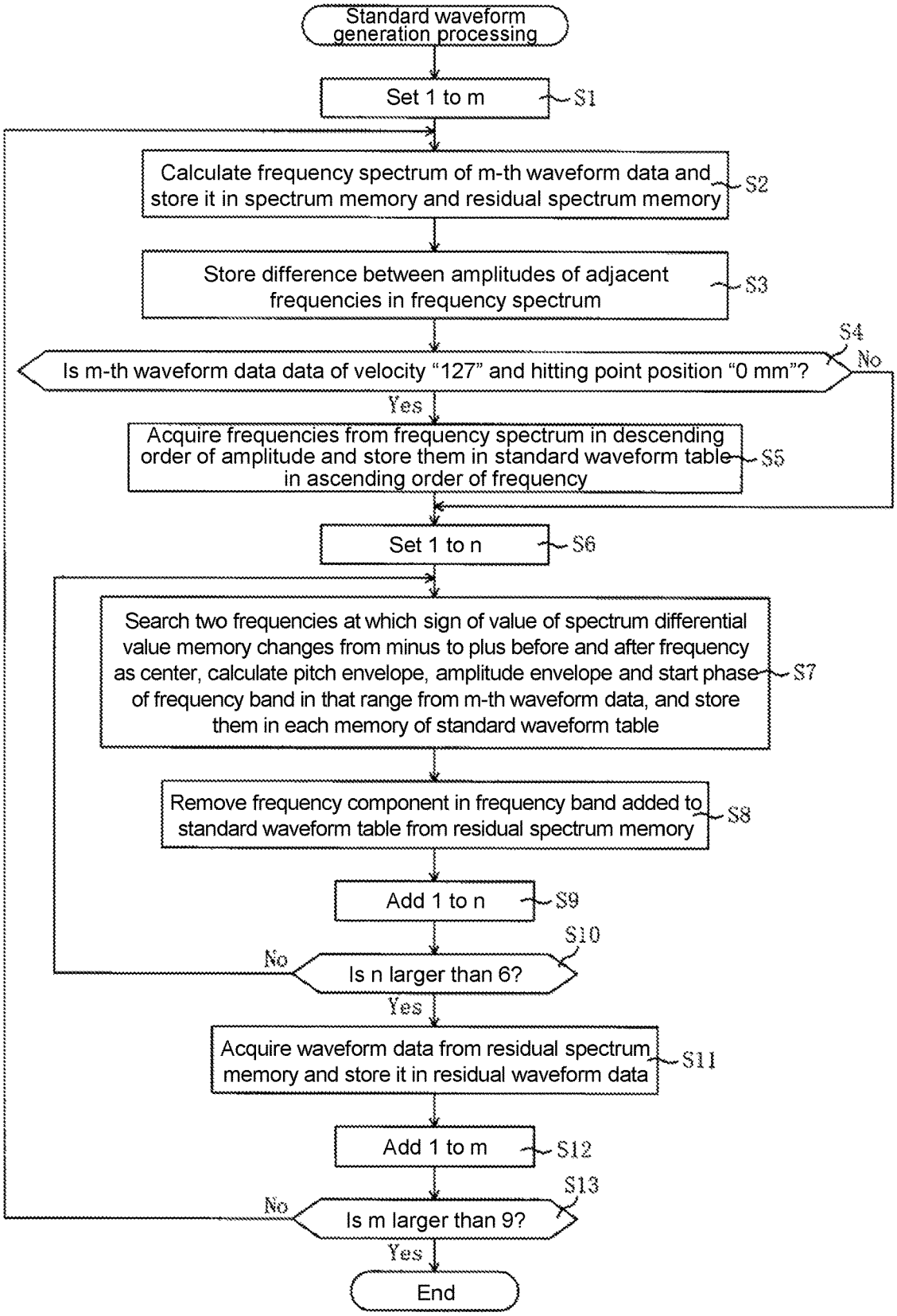
FIG. 4 is a flowchart of standard waveform generation processing executed by the PC.

The CPU 40 is an arithmetic device that controls each unit connected via the bus line 43. The HDD 41 is a rewritable nonvolatile storage device. The HDD 41 is provided with a waveform information generation program 41*a*, the waveform data 41*b*, and the waveform table 41*c*. When the waveform information generation program 41*a* is executed by the CPU 40, standard waveform generation processing of FIG. 4 is executed.

Waveform data 41*b* (that is, original waveforms of sounds of a percussion instrument) obtained by sampling musical sounds of a drum (sounds of a percussion instrument) is stored in the waveform data 41*b*. Although not shown, a total of nine pieces of waveform data including three levels of velocity and three positions of hitting point position are stored by being mapped in association with each other in the waveform data 41*b*. As will be described in detail later, three levels of velocity of "127," "70," and "40" are provided. The hitting point position is a distance from a center position CP (see FIG. 9(*a*)) of the struck surface 30 of the electronic drum pad 3, and three positions of the hitting point position of "0 mm," "75 mm," and "150 mm" are provided. In the waveform data 41*b*, waveform data of velocity "127" and hitting point position "0 mm," waveform data of velocity "70" and hitting point position "0 mm," . . . , and waveform data of velocity "40" and hitting point position "150 mm" are stored in this order. The reason why the waveform data of velocity "127" and hitting point position "0 mm" is stored at the beginning of the waveform data 41*b* is that the "noticeable" frequency band, which will be described later, is extracted based on this waveform data.

In the present embodiment, each piece of waveform data in the waveform data 41*b* is acquired from another PC or another audio device via the external input/output terminal 48 which will be described later. Also, the waveform data in the waveform data 41*b* may be data obtained by the PC 4 by sampling performance sounds of a drum acquired from a microphone (not shown) connected to the PC 4 and making them into waveform data. Further, in the present embodiment, a sampling frequency of each piece of waveform data of the waveform data 41*b* is set to 44,100 Hz.

The waveform table 41*c* is a table in which waveform information corresponding to a plurality of velocities and a plurality of hitting point positions is stored. The waveform information is information in which standard waveform tables SW1 to SW9 (see FIG. 3(*a*)), in which information on the "noticeable" frequency band extracted from the waveform data 41*b* is stored, and residual waveform data RW1 to RW9, which store waveforms (namely, residual waveforms) where the "noticeable" frequency band is removed from the waveform data 41*b*, are included as a set of data. The waveform table 41*c* will be described with reference to FIG. 2(*b*).

FIG. 2(*b*) is a diagram schematically showing the waveform table 41*c*. The waveform table 41*c* has waveform information for the hitting point position AP1, the hitting point position AP2, and the hitting point position AP3 for each hitting velocity, and these are stored by being mapped in association with each other. In the present embodiment, three levels of velocity of "127," "70," and "40" are provided. The hitting point positions AP1 to AP3 are distances from the center position CP (see FIG. 9(*a*)) of the struck surface 30 of the electronic drum pad 3, and three positions are provided in which the hitting point position AP1 is "0 mm," the hitting point position AP2 is "75 mm," and the hitting point position AP3 is "150 mm." The waveform information (the standard waveform table SW1 and the residual waveform data RW1) to (the standard waveform table SW9 and the residual waveform data RW9) (hereinafter simply referred to as (SW1, RW1) to (SW9, RW9) and the like) on the three levels of velocity and three positions of hitting point position AP1 to AP3 is stored.

The standard waveform tables SW1 to SW9 are tables in which the pitch envelope, the amplitude envelope, and the start phase of the "noticeable" frequency band among the waveform data stored in the waveform data 41*b* are stored for each frequency. In the present embodiment, the "noticeable" frequency band is a frequency band in which the amplitude of the frequency spectrum calculated from the waveform data of the velocity "127" and the hitting point position "0 mm" is large, and six frequency bands are selected in descending order of amplitude. The standard waveform tables SW1 to SW9 will be described with reference to FIGS. 3(*a*) to 3(*c*).

FIG. 3(*a*) is a diagram schematically showing standard waveform tables SW1 to SW9. The standard waveform tables SW1 to SW9 have pitch envelope data SW1*b* to SW9*b*, amplitude envelope data SW1*c* to SW9*c*, and start phase data SW1*d* to SW9*d* for each of the frequencies SW1*a* to SW9*a*, and are stored by being mapped in association with each other. Also, since the standard waveform table SW1 and the standard waveform tables SW2 to SW9 have the same data structure, descriptions of the standard waveform tables SW2 to SW9 will be omitted.

At the frequency SW1*a*, a central frequency in the "noticeable" frequency band acquired from the waveform data of the velocity "127" and the hitting point position "0 mm" in the waveform data 41*b* is stored. Six frequencies are extracted as the "noticeable" frequency band from the frequency spectrum of the waveform data corresponding to the velocity "127" and the hitting point position "0 mm" in descending order of amplitude, and the central frequency thereof is stored in the frequency SW1*a*. The pitch envelope data SW1*b*, the amplitude envelope data SW1*c* and the start phase data SW1*d*, which correspond to the frequency SW1*a*, are stored in the standard waveform table SW1. Also, the same frequencies are stored in the frequencies SW1*a* to SW9*a* of the standard waveform tables SW1 to SW9.

A pitch envelope for each frequency of the frequency SW1*a* is stored in the pitch envelope data SW1*b*. The pitch envelope is a value representing an envelope curve (envelope) of a temporal change of the pitch. In the present embodiment, the pitch envelope data P1 to P6 are mapped in association with the respective frequencies of the frequency SW1*a* and are stored in the pitch envelope data SW1*b*. The pitch envelope data P1 will be described with reference to FIG. 3(*b*). Also, since the pitch envelope data P1 and the pitch envelope data P2 to P6 have the same data structure, descriptions of the pitch envelope data P2 to P6 will be omitted.

FIG. 3(*b*) is a diagram schematically showing the pitch envelope data P1. The pitch envelope data P1 has a time P11 and pitch data P12, and these are stored by being mapped in association with each other. The pitch envelope data P1 is adjusted such that its length is the same as the longest waveform data (3 seconds in the present embodiment) of the waveform data 41*b*.

At time P11, a time (the unit is ms) for taking a pitch envelope point is stored. The pitch envelope point indicates a certain point on the pitch envelope. Also, the same time P11 is stored in the pitch envelope data SW1*b* to SW9*b* of the same frequencies SW1*a* to SW9*a* in the standard waveform tables SW1 to SW9. Specifically, 128 pitch envelope points are extracted from the entire waveform data in the waveform data 41*b*, including a start time (0 ms) and an end time (3000 ms) of the pitch envelope, and the times to take the pitch envelope points are acquired. The acquired 128 times are stored at time P11 of the respective pitch envelope data SW1*b* to SW9*b* of the same frequency. Also, time intervals of the 128 pitch envelope points are set to be shorter in an attack section and set to be longer in a release section. This is to faithfully reproduce sounds of a percussion instrument. Various sine wave components can be reproduced by setting the pitch envelope points (amplitude envelope points which will be described later) in this way.

In the pitch data P12, the values (the unit is cent) of the pitch envelope points at time P11 acquired from the waveform data of the corresponding velocity at the hitting point position in the waveform data 41*b* are stored. That is, 128 values for the pitch envelope points corresponding to the time P11 are stored in the pitch data P12 exemplified in FIG. 3(*b*).

Returning to FIG. 3(*a*), an amplitude envelope for each frequency of the frequency SW1*a* is stored in amplitude envelope data SW1*c*. The amplitude envelope is a value representing an envelope of a temporal change of an amplitude level. In the present embodiment, amplitude envelope data A1 to A6 are mapped in association with the respective frequencies of the frequency SW1*a* and stored in the amplitude envelope data SW1*c*. The amplitude envelope data A1 will be described with reference to FIG. 3(*c*). Also, since the amplitude envelope data A1 and the amplitude envelope data A2 to A6 have the same data structure, descriptions of the amplitude envelope data A2 to A6 will be omitted.

FIG. 3(*c*) is a diagram schematically showing the amplitude envelope data A1. The amplitude envelope data A1 has a time A11 and amplitude level data A12, and these are stored by being mapped in association with each other. The amplitude level data A12 is also adjusted such that its length is the same as the longest waveform data (3 seconds in the present embodiment) of the waveform data 41*b*.

At time A11, a time (the unit is ms) for taking an amplitude envelope point is stored. The amplitude envelope point indicates a certain point on the amplitude envelope. Also, the same time A11 is stored in the amplitude envelope data SW1*c* to SW9*c* of the same frequencies SW1*a* to SW9*a* in the standard waveform tables SW1 to SW9. Specifically, 128 amplitude envelope points are extracted from the entire waveform data in the waveform data 41*b*, including a start time (0 ms) and an end time (3000 ms) of the amplitude envelope, and the times to take the amplitude envelope points are acquired. The acquired 128 times are stored at time A11 of the respective amplitude envelope data SW1*c* to SW9*c* of the same frequency. Also, time intervals of the 128 amplitude envelope points are set to be shorter in an attack section and set to be longer in a release section.

In the amplitude level data A12, the values (the unit is dB) of the amplitude envelope points at time A11 acquired from the waveform data of the corresponding velocity the hitting point position in the waveform data 41*b* are stored. That is, 128 values for the amplitude envelope points corresponding to the time A11 are stored in the amplitude level data A12 exemplified in FIG. 3(*c*).

Generally, when a drum sound begins to sound, the tone color changes greatly, and then the change gradually becomes gentle. A change of the pitch in a certain frequency component becomes gentle as time elapses from the beginning of sounding, and a change of the amplitude level (that is, the volume) also becomes gentle as time elapses from the beginning of sounding. For that reason, in the present embodiment, by generating musical sounds based on the pitch envelope data SW1*b* representing the temporal change of the pitch and the amplitude envelope data SW1*c* representing the temporal change of the amplitude level, it is possible to reproduce more drum-like tone color changes.

Returning to FIG. 3(*a*), in the start phase data SW1*d*, a phase at the start of the waveform for each frequency of the frequency SW1*a*, that is, the phase at "0 ms" of the pitch envelope data P1 and the amplitude envelope data A1 is stored. In the present embodiment, the phase at the start of the waveform for each frequency is referred to as a "start phase."

Returning to FIG. 2(*b*), the waveform data of the frequency components in which the "noticeable" frequency band stored in the corresponding standard waveform tables SW1 to SW9 is removed from each of the nine pieces of waveform data 41*b* stored in accordance with the velocity and hitting point position are stored in the residual waveform data RW1 to RW9. The residual waveform data RW1 to RW9 contain frequency components which are not "noticeable" frequency bands but constitute a drum sound. For that reason, in addition to a sine wave obtained by performing a weighting operation on the plurality of standard waveform tables SW1 to SW9, a weighting operation on a plurality of pieces of residual waveform data RW1 to RW9 is also performed, and then the two are mixed to generate sounds. As a result, musical sounds in the entire frequency band included in the waveform data 41*b* are generated.

This waveform table 41*c* is transmitted to the electronic drum sound source device 2 and stored in the waveform table 22*a* (FIG. 6) of the electronic drum sound source device 2 having the same data structure. Then, when detecting hits on the struck surface 30, the electronic drum sound source device 2 selects four pieces of approximate waveform information from the waveform table 22*a* in accordance with the velocity and the hitting point position, and, from the standard waveform tables SW1 to SW9 of the selected waveform information, generates a sine wave for each frequency on which a weighting operation has been performed and waveforms which are synthesized after a weighting operation has been performed on the residual waveform data RW1 to RW9 of the selected waveform information, as musical sounds.

The RAM 42 is a memory in which the CPU 40 rewritably stores various pieces of work data, flags, etc., when the CPU 40 executes programs such as the waveform information generation program 41*a* and the like. The RAM 42 is provided with a spectrum memory 42*a*, a spectrum differential value memory 42*b*, and a residual spectrum memory 42*c*.

The spectrum memory 42*a* is a memory for storing the frequency spectrum of the waveform data. When the power of the PC 4 is turned on and immediately after the standard waveform generation processing of FIG. 4 is executed, the spectrum memory 42*a* is initialized to "0" indicating that no frequency spectrum is stored. Then, in the standard waveform generation processing of FIG. 4, the frequency spectrum calculated from the waveform data of the waveform data 41*b* is stored in the spectrum memory 42*a* (S2 of FIG. 4). In the standard waveform generation processing, since a "noticeable" frequency band is extracted from the spectrum memory 42*a* calculated from the waveform data of the velocity "127" and the hitting point position "0 mm," six frequencies with large amplitudes of the values of the spectrum memory 42*a* are extracted.

The spectrum differential value memory 42*b* is a memory that stores differential values of the frequency spectrum of the waveform data. A "differential value of a frequency spectrum" refers to the difference in amplitude between adjacent frequencies in the frequency spectrum. When the power of the PC 4 is turned on and immediately after the standard waveform generation processing of FIG. 4 is executed, the spectrum differential value memory 42*b* is initialized to "0" indicating that a differential value of the frequency spectrum is not stored. In the standard waveform generation processing of FIG. 4, the differential value of the frequency spectrum calculated from the smoothed value of the spectrum memory 42*a* is stored in the spectrum differential value memory 42*b* (S3 of FIG. 4). In the present embodiment, two frequencies at which the sign of the value of the spectrum differential value memory 42*b* changes from minus to plus, that is, a "valley bottom," are specified before and after the frequency with the large amplitude of the value of the spectrum memory 42*a* calculated from the waveform data of the velocity "127" and the hitting point position "0 mm" as a center. The frequency band between the valley bottoms is set to be a "noticeable" frequency band, and the pitch envelope, the amplitude envelope, and the start phase of the frequency band are stored in the standard waveform tables SW1 to SW9.

The residual spectrum memory 42*c* is a memory for storing the frequency spectrum from which the frequency bands stored in the standard waveform tables SW1 to SW9 are removed from the value of the spectrum memory 42*a*. The residual spectrum memory 42*c* is initialized to "0" indicating that no frequency spectrum is stored when the power of the PC 4 is turned on and immediately after the standard waveform generation processing of FIG. 4 is executed. In the standard waveform generation processing of FIG. 4, the frequency spectrum calculated from the waveform data of the waveform data 41*b* is stored in the residual spectrum memory 42*c* (S2 of FIG. 4). Then, the frequency spectrum of the frequency band stored in the standard waveform tables SW1 to SW9 is removed from the residual spectrum memory 42*c* (S8 of FIG. 4), and the values of the residual spectrum memory 42*c* in the time domain waveform are stored in the residual waveform data RW1 to RW9 (S11 of FIG. 4).

The LCD 45 is a display for displaying a display screen. The mouse 46 and the keyboard 47 are input devices for inputting instructions from the user and various kinds of information to the PC 4. The external input/output terminal 48 is an interface for transmitting and receiving data between the PC 4 and the electronic drum sound source device 2 or another computer. The waveform table 41*c* of the PC 4 is transmitted to the electronic drum sound source device 2 via the external input/output terminal 48. In addition, the PC 4 receives the waveform data generated by another PC or another audio device via the external input/output terminal 48. Also, in place of the external input/output terminal 48, data may be transmitted and received via a network connection via a local area network (LAN) (not shown), or data may be transmitted and received via the Internet.

Figure 5:
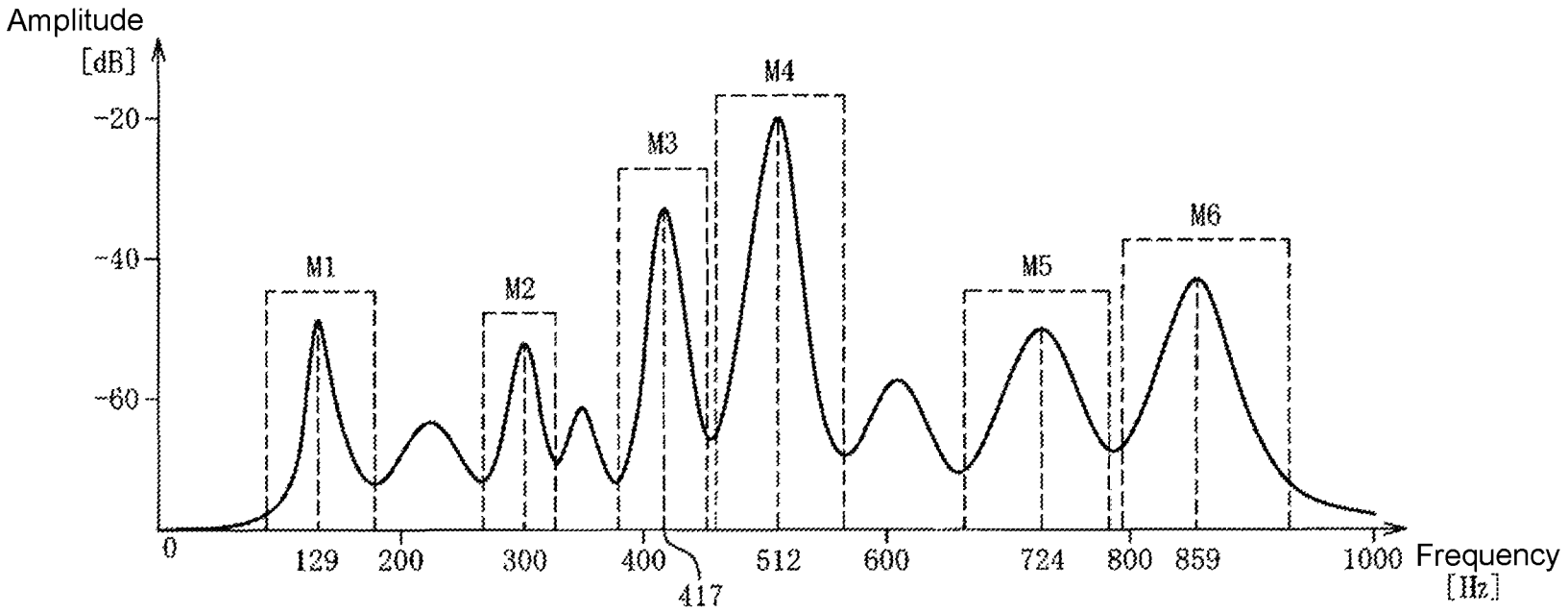
FIG. 5 is a graph showing a frequency spectrum of waveform data.

Next, standard waveform generation processing executed by the CPU 40 of the PC 4 will be described with reference to FIGS. 4 and 5. FIG. 4 is a flowchart of the standard waveform generation processing. By performing the standard waveform generation processing, the pitch envelope, the amplitude envelope, and the start phase of the "noticeable" frequency band from the waveform data 41*b* are stored in the standard waveform tables SW1 to SW9 of the waveform table 41*c*. Waveforms of other frequency components are stored in the residual waveform data RW1 to RW9. The standard waveform generation processing is executed when an execution instruction is given from the mouse 46 or the keyboard 47 by the user.

In the standard waveform generation processing, first, m is set to 1 (S1). m is a natural number and is a value indicating the position of the waveform data stored in the waveform data 41*b* and the positions of the standard waveform tables SW1 to SW9 and the residual waveform data RW1 to RW9. Hereinafter, "m-th" means "1st" when the value of m is 1, "2nd" when the value of m is 2, . . . , "9th" when the value of m is 9, respectively. Also, the "standard waveform table SWm" has a value of "standard waveform table SW1" when the value of m is 1, "standard waveform table SW2" when the value of m is 2, . . . , "standard waveform table SW9" when the value of m is 9, respectively (hereinafter, the frequencies SW1*a* to SW9*a* and the like, and the residual waveform data RW1 to RW9 are also similarly expressed).

After the processing of S1, the frequency spectrum of the m-th waveform data in the waveform data 41*b* is calculated and stored in the spectrum memory 42*a* and the residual spectrum memory 42*c* (S2). The frequency spectrum is calculated by performing well-known discrete Fourier transformation on the m-th waveform data in the waveform data 41*b*. In the following processing, the spectrum memory 42*a* is used for calculating the pitch envelope, the amplitude envelope, and the start phase of the "noticeable" frequency band. The residual spectrum memory 42*c* is used to create a waveform of the frequency component from which the "noticeable" frequency band has been removed.

After the processing of S2, the difference between the amplitudes of adjacent frequencies of the frequency spectrum of the m-th waveform data in the waveform data 41*b* is stored in the spectrum differential value memory 42*b* (S3). More specifically, the differential value of the above-described frequency spectrum is obtained from the smoothed value of the spectrum memory 42*a*, and the results are stored in the spectrum differential value memory 42*b*. Smoothing the value of the spectrum memory 42*a* is for removing noise of the value of the spectrum memory 42*a*. In the processing of S7 which will be described later, a frequency at which the sign of the value of the spectrum differential value memory 42*b* changes from minus to plus before and after the frequency SWma of the m-th standard waveform table SWm as a center is retrieved from the spectrum differential value memory 42*b* in order to acquire the "noticeable" frequency band. Accordingly, if the difference between the amplitudes of adjacent frequencies is calculated while including minute fluctuations in the value of the spectrum memory 42*a*, a frequency band which is not originally the "noticeable" frequency band is erroneously determined to be a "noticeable" frequency band. For that reason, by obtaining the differential value of the frequency spectrum from the smoothed value of the spectrum memory 42*a*, it is possible to more accurately acquire the "noticeable" frequency band.

After the processing of S3, it is checked whether or not the m-th waveform data in the waveform data 41*b* is the waveform data of the velocity "127" and the hitting point position "0 mm" (S4). When the m-th waveform data in the waveform data 41*b* is at the velocity "127" and the hitting point position "0 mm" (S4: Yes), the frequencies are acquired in descending order of amplitude from the value of the spectrum memory 42*a* and are stored in the frequencies SW1*a* to SW9*a* of the standard waveform tables SW1 to SW9 in ascending order of frequency, respectively (S5). On the other hand, if the m-th waveform data in the waveform data 41*b* is not at the velocity "127" and the hitting point position "0 mm" (S4: No), the processing of S5 is skipped. As a result, the frequency which is the center of the "noticeable" frequency band is acquired from the waveform data of the velocity "127" and the hitting point position "0 mm" in the waveform data 41*b*, and the obtained frequencies are stored in the frequencies SW1*a* to SW9*a* of the standard waveform tables SW1 to SW9, respectively.

After the processing of S4 and S5, n is set to 1 (S6). n is a natural number and is a value indicating the position of the acquisition/storage destination of the standard waveform table SWm. Hereinafter, "n-th" means "1st" when the value of n is 1, "2nd" when the value of n is 2, . . . , "6th" when the value of n is 6, respectively.

After the processing of S6, a frequency closest to the frequency SWma of the n-th standard waveform table SWm is selected. Two frequencies at which the sign of the value of the spectrum differential value memory 42*b* changes from minus to plus before and after the selected frequency as a center are searched for in the spectrum differential value memory 42*b*. The pitch envelope, the amplitude envelope, and the start phase of the frequency band in that range are calculated from the m-th waveform data in the waveform data 41*b* and stored in each memory of the standard waveform table SWm (S7).

Specifically, in the processing of S5, the frequency SWma of the n-th standard waveform table SWm is specified as a "mountain top" of a curve connecting adjacent frequencies in the spectrum memory 42*a*. A lump of a mountain including the "mountain top" is made into the "noticeable" frequency band. Therefore, two frequencies at which the sign of the value of the spectrum differential value memory 42*b* changes from minus to plus before and after the frequency closest to the frequency SWma, that is, two frequencies which are the "valley bottoms" at both ends around the mountain peak are searched. The frequency band between these "valley bottoms" is the "noticeable" frequency band. By performing a well-known Hilbert transformation on the m-th waveform data in the waveform data 41*b* for the frequency band between the "valley bottoms," the pitch envelope, amplitude envelope and start phase are calculated. At this time, the lengths of the pitch envelope and amplitude envelope are adjusted to be 3 seconds each. Also, during the time when the pitch envelope and the amplitude envelope are stored (that is, the time P11 and the time A11), 128 times acquired as a result of analyzing all the waveform data in the waveform data 41*b* are provided in advance. In addition, based on the time P11 and the time A11, the pitch envelope and the amplitude envelope are calculated.

The pitch envelope, amplitude envelope, and start phase are stored in the pitch envelope data SWmb, the amplitude envelope data SWmc, and the start phase data SWmd of the corresponding frequency SWma of the standard waveform table SWm, respectively. As a result, it is possible to acquire the pitch envelope, the amplitude envelope, and the start phase of the "noticeable" frequency band for each frequency. In this way, since a lump of the mountain including the "mountain top" is set as the "noticeable" frequency band rather than the frequency of the "mountain top" of the curve connecting adjacent frequencies in the spectrum memory 42*a*, it is possible to store changes in pitch and amplitude for a wider frequency band. Therefore, it is possible to reproduce more drum-like sounds when musical sounds are generated using the electronic drum 1.

After the processing of S7, the frequency component of the frequency band stored in the standard waveform table SWm is removed from the residual spectrum memory 42*c* (S8). Specifically, in the residual spectrum memory 42*c*, frequency components in the frequency band stored in the standard waveform table SWm in the processing of S8 are removed. As a result, frequency components in the "noticeable" frequency band can be removed from the residual waveform data RWm created from the residual spectrum memory 42*c* in S11 which will be described later.

Here, the processing of S5 to S8 will be described with reference to FIG. 5. FIG. 5 is a graph showing the frequency spectrum of the waveform data of the velocity "127" and the hitting point position "0 mm" in the waveform data 41*b*. The horizontal axis represents frequency (Hz), and the vertical axis represents amplitude (dB). The frequency spectrum of this waveform data is a curve having a plurality of "mountains." In FIG. 5, M1 to M6 correspond to the "noticeable" frequency band, and their frequency bands are indicated by dotted lines. In M1 to M6, the valley bottoms before and after the mountain top become both ends of the frequency band.

In the standard waveform generation processing, first, six "mountain tops" having large amplitudes are searched from the value of the spectrum memory 42*a* (S5). When the "mountain tops" are found, two "valley bottoms" at which the sign of the value of the spectrum differential value memory 42*b* changes from minus to plus before and after the frequency closest to the mountain top frequency are found. That is, both ends of the dotted line on the horizontal axis in M1 to M6 in FIG. 5 correspond to the "valley bottoms." With respect to the frequency band between valley bottoms in M1 to M6, the pitch envelope, the amplitude envelope, and the start phase are calculated for each frequency and stored in the standard waveform table SWm (S7). On the other hand, the residual obtained by removing the frequency components of the frequency bands M1 to M6 from the spectrum memory 42*a* is stored in the residual spectrum memory 42*c* (S8).

In addition, note that the "sine wave component" described in the claims means the pitch envelope, amplitude envelope and the start phase of the "noticeable" frequency band of the waveform data. Also, the "residual component" means a component other than the "sine wave component" of the waveform data 41*b*.

Returning to FIG. 4, after the processing of S8, 1 is added to n (S9). After the processing of S9, it is checked whether or not n is larger than 6 (S10). Since the number of pieces of data stored in the standard waveform table SWm is six, it is checked whether or not n is larger than the upper limit of "6." If n is larger than 6 (S10: Yes), waveform data is acquired from the residual spectrum memory 42*c* and stored in the residual waveform data RWm (S11). As a result of the processing of S7 and S8, the residual spectrum memory 42*c* includes only frequency components from which the frequency bands stored in the standard waveform table SWm are removed. The waveform data in the time domain, that is, the residual waveform data is acquired from the residual spectrum memory 42*c* and stored in the residual waveform data RWm. Also, as a method of obtaining the value of the residual spectrum memory 42*c* as the waveform data in the time domain, a well-known inverse discrete Fourier transformation can be mentioned.

In the processing of S10, if n is 6 or less (S10: No), the processing of S7 is performed. After the processing of S11, 1 is added tom (S12). After the processing of S12, it is checked whether or not m is larger than 9 (S13). Since the number of waveform data in the waveform data 41*b* and the number of the standard waveform table SWm and the residual waveform data RWm stored in the waveform table 41*c* are 9 each, it is checked whether or not m is larger than the upper limit of "9." When m is larger than 9 (S13: Yes), the standard waveform generation processing is terminated. On the other hand, if m is less than or equal to 9 (S13: No), the processing of S2 is performed.

As described above, in the standard waveform generation processing, the "noticeable" frequency band (that is, the main sine wave component) is specified from the spectrum memory 42*a* which is the frequency spectrum of the waveform data of the waveform data 41*b* and the spectrum differential value memory 42*b* which is the differential value of the spectrum memory 42*a*, and the pitch envelope, the amplitude envelope and the start phase of the frequency band are stored in the standard waveform tables SW1 to SW9. On the other hand, the waveform data (that is, the residual components) of frequency bands not stored in the standard waveform tables SW1 to SW9 are stored in the residual waveform data RW1 to RW9. Since the pitch envelope and the amplitude envelope of the characteristic "noticeable" frequency band, that is, the temporal changes of the pitch and amplitude are stored in this way, it is possible to suitably reproduce drum-like tone color changes. In addition, since the frequency band from which the "noticeable" frequency band is removed is also stored in the residual waveform data RW1 to RW9, by matching it with the musical sounds resulting from the standard waveform tables SW1 to SW9, sounds of the entire frequency band of the drum sound can be reproduced.

Figure 6:
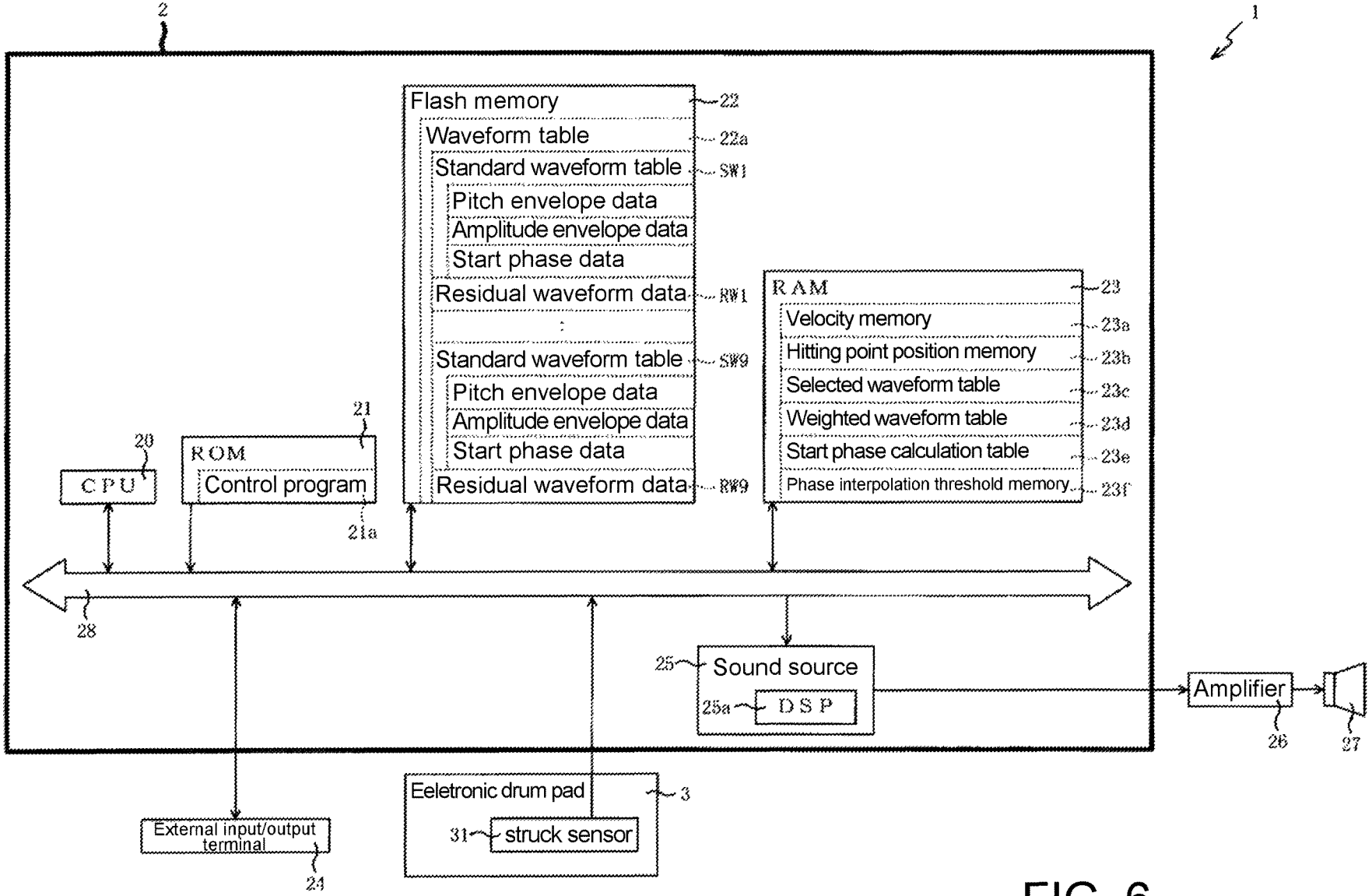
FIG. 6 is a block diagram showing an electrical configuration of the electronic drum.

Next, an electrical configuration of the electronic drum 1 will be described with reference to FIGS. 6 and 7(*a*)~7(*c*). FIG. 6 is a block diagram showing the electrical configuration of the electronic drum 1. The electronic drum 1 is configured by the electronic drum sound source device 2 and the electronic drum pad 3. The electronic drum sound source device 2 includes the CPU 20, a read only memory (ROM) 21, the flash memory 22, the RAM 23, the external input/output terminal 24, the electronic drum pad 3, and a sound source 25, which are connected via a bus line 28. An amplifier 26 is connected to the sound source 25, and the speaker 27 is connected to the amplifier 26.

Figure 10:
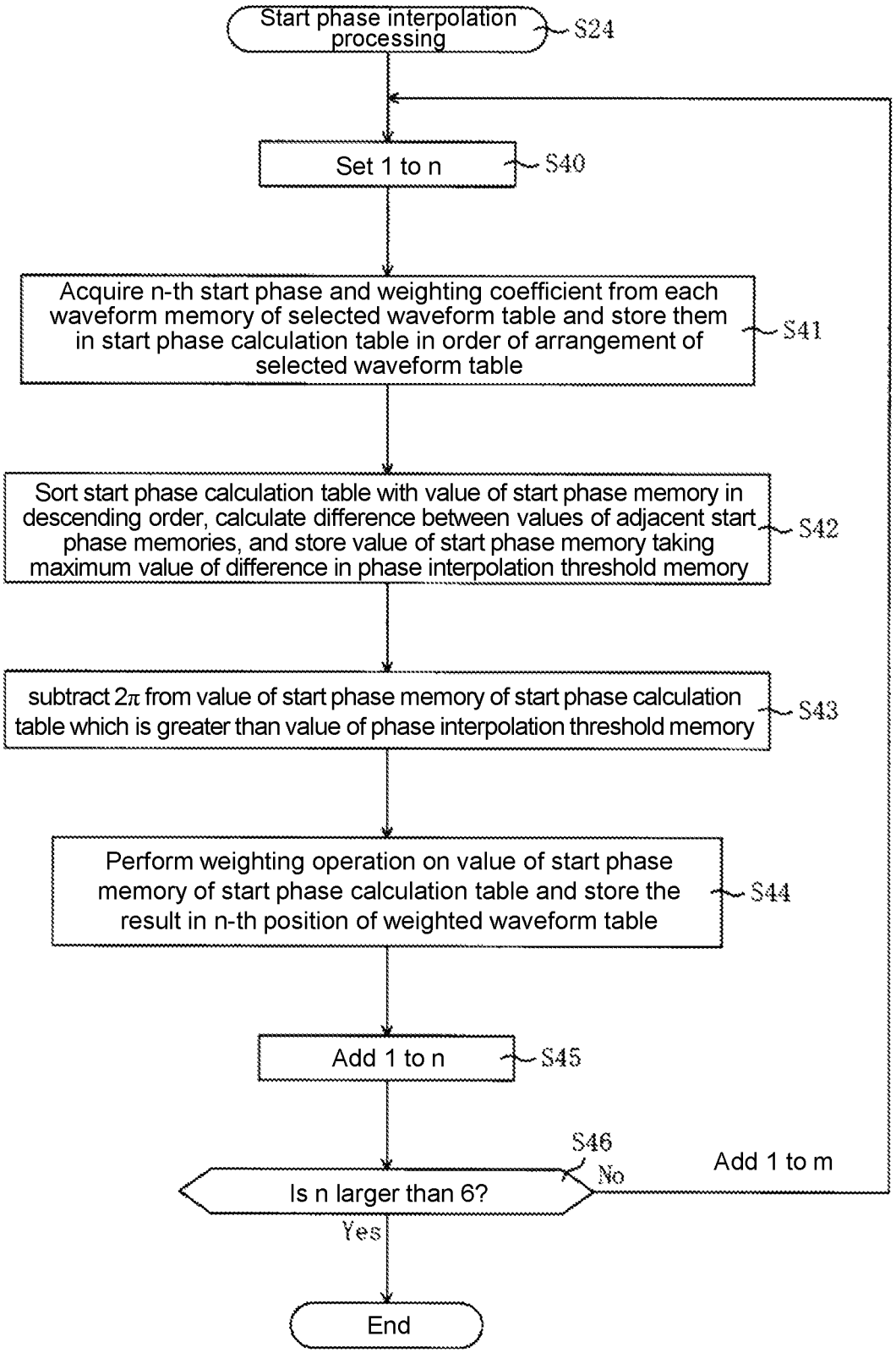
FIG. 10 is a flowchart of start phase interpolation processing executed by an electronic drum sound source device.

The CPU 20 is an arithmetic device that controls each unit connected via the bus line 28. The ROM 21 is a non-rewritable memory. The ROM 21 stores a control program 21*a* to be executed by the CPU 20 and fixed value data (not shown) and the like referenced by the CPU 20 when the control program 21*a* is executed. When the control program 21*a* is executed by the CPU 20, beating detection processing of FIG. 8 and start phase interpolation processing of FIG. 10 are executed.

The flash memory 22 is a rewritable nonvolatile memory, and is provided with the waveform table 22*a*. The waveform table 22*a* is a table that stores waveform information of the electronic drum pad 3 which correspond to a plurality of velocities and a plurality of hitting point positions. The waveform table 22*a* stores the above-described waveform table 41*c* (see FIG. 2(*b*)) of the PC 4 received via the external input/output terminal 24. Since the waveform table 22*a* has the same data structure as the waveform table 41*c*, detailed descriptions thereof will be omitted. In the beating detection processing of FIG. 8, the waveform information approximating the hitting point position and the velocity of the electronic drum pad 3 on the struck surface 30 is acquired from the waveform table 22*a*, a weighting operation has been performed thereon and then sounds are generated as musical sounds.

Returning to FIG. 6, the RAM 23 is a memory for rewritably storing various work data, flags, etc., when the CPU 20 executes programs such as the control program 21*a*. The RAM 23 is provided with a velocity memory 23*a*, a hitting point position memory 23*b*, a selected waveform table 23*c*, a weighted waveform table 23*d*, a start phase calculation table 23*e*, and a phase interpolation threshold memory 23*f*.

The velocity memory 23*a* is a memory for storing the velocity of the musical sound detected from the output value (the result of detection) of the struck sensor 31 of the electronic drum pad 3 which will be described later. When the power of the electronic drum sound source device 2 is turned on, the velocity memory 23*a* is initialized to "0" indicating that the velocity is not stored. In the beating detection processing of FIG. 8, the velocity is detected based on the output value from the struck sensor 31 and stored in the velocity memory 23*a* (S20 of FIG. 8). The velocity memory 23*a* takes a value in the range from 0 (weak) to 127 (strong) depending on the hit strength detected by the struck sensor 31.

The hitting point position memory 23*b* is a memory for storing the hitting point position (the unit is mm) of the musical sound detected from the output value of the struck sensor 31. When the power of the electronic drum sound source device 2 is turned on, the hitting point position memory 23*b* is initialized to "0" indicating that the hitting point position is not stored. In the beating detection processing of FIG. 8, the hitting point position is detected based on the output value from the struck sensor 31 and stored in the hitting point position memory 23*b* (S20 of FIG. 8). In the present embodiment, the hitting point position of the musical sound is the distance from the center position CP (see FIG. 9 (*a*)) of the struck surface 30. In accordance with the value of the velocity memory 23*a* and the value of the hitting point position memory 23*b*, approximate waveform information is selected from the waveform table 22*a* (S21 of FIG. 8). Further, weighting coefficients of the approximate waveform information are calculated in accordance with the value of the velocity memory 23*a* and the value of the hitting point position memory 23*b* which will be described later (S22 of FIG. 8).

The selected waveform table 23*c* is a table for storing waveform information approximating to the value of the velocity memory 23*a* and the value of the hitting point position memory 23*b* acquired from the waveform table 22*a* and its weighting coefficients. The selected waveform table 23*c* will be described with reference to FIG. 7(*a*).

FIG. 7(*a*) is a diagram schematically showing the selected waveform table 23*c*. The selected waveform table 23*c* has a waveform memory 23*c*1 and a weighting coefficient memory 23*c*2, and these are stored by being mapped in association with each other. In the present embodiment, four combinations of the waveform memory 23*c*1 and the weighting coefficient memory 23*c*2 is provided including No. 1 to No. 4.

Figure 8:
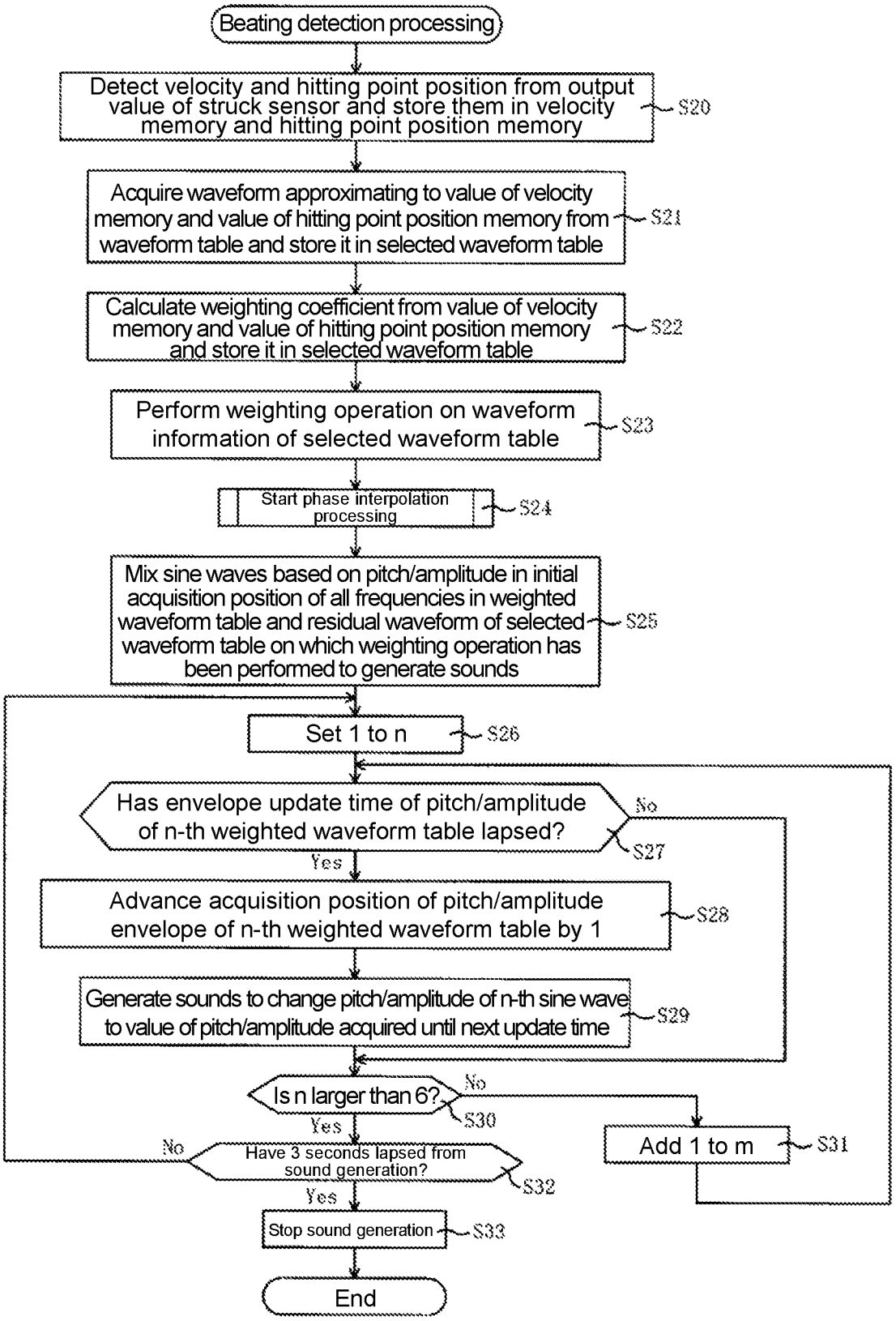
FIG. 8 is a flowchart of beating detection processing executed by an electronic drum sound source device.

The waveform memory 23*c*1 is a memory for storing waveform information approximating to the value of the velocity memory 23*a* and the value of the hitting point position memory 23*b* in the waveform table 22*a*. The waveform memory 23*c*1 is initialized to "0" indicating that waveform information is not stored when the power of the electronic drum sound source device 2 is turned on and immediately after the beating detection processing of FIG. 8 is executed. Four pieces of waveform data in which two sets of velocities of the waveform table 22*a* approximating to the value of the velocity memory 23*a* are combined with two sets of hitting point positions AP1 to AP3 of the waveform table 22*a* approximating to the value of the hitting point position memory 23*b*, respectively, are stored in the waveform memory 23*c*1 (S21 of FIG. 8).

For example, when the value of the velocity memory 23*a* is "75" and the value of the hitting point position memory 23*b* is "50 mm," the velocity values of the waveform table 22*a* approximating to the case where the value of the velocity memory 23*a* is "75" are "127" and "70." Also, the hitting point positions of the waveform table 22*a* approximating to the case where the value of the hitting point position memory 23*b* is "50 mm" are "0 mm" (that is, the hitting point position AP1) and "75 mm" (that is, the hitting point position AP2). Therefore, in this case, the waveform information of the waveform table 22*a* stored in the waveform memory 23*c*1 is four, i.e., "(SW1, RW1)," "(SW2, RW2)," "(SW4, RW4)," and "(SW5, RW5)." Also, the standard waveform tables SW1 to SW9 and the residual waveform data RW1 to RW9 are stored in No. 1 to No. 4 of the waveform memory 23*c*1 in ascending order of the suffix numbers.

The weighting factor memory 23*c*2 is a memory for storing the weighting coefficients of the waveform information stored in the waveform memory 23*c*1. When the power of the electronic drum sound source device 2 is turned on and immediately after the beating detection processing of FIG. 8 is executed, the weighting coefficient memory 23*c*2 is initialized to "0" indicating that no weighting coefficient is stored. As will be described in detail later, a weighting coefficient is calculated from the value of the velocity memory 23*a*, the value of the hitting point position memory 23*b*, the velocity values of the waveform table 22*a* and the hitting point positions AP1 to AP3 which correspond to the waveform information stored in the waveform memory 23*c*1, and stored in the weighting coefficient memory 23*c*2 (S22 of FIG. 8).

Returning to FIG. 6, the weighted waveform table 23*d* is a table for storing the pitch envelope, the amplitude envelope, and the start phase calculated by performing a weighting operation for each frequency. The weighted waveform table 23*d* will be described with reference to FIG. 7(*b*). FIG. 7(*b*) is a diagram schematically showing the weighted waveform table 23*d*. The weighted waveform table 23*d* has pitch envelope data 23*d*2, amplitude envelope data 23*d*3, and start phase data 23*d*4 for each frequency 23*d*1, and these are stored by being mapped in association with each other.

The frequency 23*d*1 stores the frequencies SW1*a* to SW9*a* at the same storage position in the standard waveform tables SW1 to SW9 of the waveform information which are stored in the waveform memory 23*c*1 of the selected waveform table 23*c*. The value of the frequency 23*d*1 is used as the frequency of each sine wave sounded by a sine wave generator of the sound source 25 in the beating detection processing of FIG. 8.

The pitch envelope data 23*d*2 stores the pitch envelope on which a weighting operation is performed by the weighting coefficient memory 23*c*2 of the selected waveform table 23*c*. When the power of the electronic drum sound source device 2 is turned on and immediately after the beating detection processing of FIG. 8 is executed, the pitch envelope data 23*d*2 is initialized to "0" indicating that the pitch envelope is not stored. Then, in the beating detection processing of FIG. 8, values (pitch envelopes wP1 to wP6) obtained by performing a weighting operation on the pitch envelope data SW1*b* to SW9*b* at the same storage position in the standard waveform tables SW1 to SW9 of the waveform information by the weighting coefficient memory 23*c*2 of the selected waveform table 23*c* are stored (S23 of FIG. 8). The value of the pitch envelope data 23*d*2 is used as the change amount of the pitch of each sine wave sounded in the beating detection processing of FIG. 8.

The amplitude envelope data 23*d*3 stores the amplitude envelope on which a weighting operation is performed by the weighting coefficient memory 23*c*2 of the selected waveform table 23*c*. When the power of the electronic drum sound source device 2 is turned on and immediately after the beating detection processing of FIG. 8 is executed, the amplitude envelope data 23*d*3 is initialized to "0" indicating that the amplitude envelope is not stored. Then, in the beating detection processing of FIG. 8, values (amplitude envelopes wA1 to wA6) obtained by performing a weighting operation on the amplitude envelope data SW1*c* to SW9*c* at the same storage position in the standard waveform tables SW1 to SW9 of the waveform information by the weighting coefficient memory 23*c*2 of the selected waveform table 23*c* are stored (S23 of FIG. 8). The value of the amplitude envelope data 23*d*3 is used as the change amount of the amplitude of each sine wave sounded in the beating detection processing of FIG. 8.

The start phase data 23*d*4 stores the start phase data SW1*d* to SW9*d* at the same storage position in the standard waveform tables SW1 to SW9 of the waveform information calculated by the start phase interpolation processing. When the power of the electronic drum sound source device 2 is turned on and immediately after the beating detection processing of FIG. 8 is executed, the start phase data 23*d*4 is initialized to "0" indicating that the start phase is not stored. The start phase data SW1*d* to SW9*d* at the same storage position in the standard waveform tables SW1 to SW9 of the waveform information calculated through the start phase interpolation processing are stored in the start phase data 23*d*4 corresponding to the storage position (S44 of FIG. 10). The value of the start phase data 23*d*4 is used as a start phase for each frequency 23*d*1 (S25 of FIG. 8).

Returning to FIG. 6, the start phase calculation table 23*e* is a table used for calculating the start phase in the start phase interpolation processing of FIG. 10. In the start phase interpolation processing of FIG. 10, the phase difference of each of the start phase data SW1*d* to SW9*d* at the same storage position in the four pieces of waveform information stored in the selected waveform table 23*c* is interpolated, and the result of performing a weighting operation thereon is stored in the start phase data 23*d*4 of the corresponding storage position in the weighted waveform table 23*d*. The start phase calculation table 23*e* is a table for performing interpolation and a weighting operation of this phase difference. The start phase calculation table 23*e* will be described with reference to FIG. 7(*c*).

FIG. 7(*c*) is a diagram schematically showing the start phase calculation table 23*e*. The start phase calculation table 23*e* has a start phase memory 23*e*1 and a weighting coefficient memory 23*e*2, and these are stored by being mapped in association with each other. The start phase memory 23*e*1 stores the start phase data SW1*d* to SW9*d* of the standard waveform tables SW1 to SW9 of the waveform memory 23*c*1 of the selected waveform table 23*c* in the order of storage of the selected waveform table 23*c*. The weighting coefficient memory 23*e*2 stores the values of the weighting coefficient memory 23*c*2 of the selected waveform table 23*c* in the order of storage of the selected waveform table 23*c*. When the power of the electronic drum sound source device 2 is turned on and immediately after the start phase interpolation processing of FIG. 10 is executed, the start phase memory 23*e*1 and the weighting coefficient memory 23*e*2 are initialized to "0" indicating that the start phase and the weighting coefficients are not stored. In the start phase interpolation processing, the values of the start phase data SW1*d* to SW9*d* of the corresponding frequency from each piece of waveform information of the selected waveform table 23*c* and the values of the weighting coefficient memory 23*c*2 of the selected waveform table 23*c* are stored in the start phase memory 23*e*1 and the weighting coefficient memory 23*e*2, respectively (S41 of FIG. 10). The start phase interpolation processing and the start phase weighting operation are performed based on the start phase calculation table 23*e* and the results thereof are stored in the start phase memory 23*e*1 (S42 to S44 of FIG. 10).

Returning to FIG. 6, the phase interpolation threshold value memory 23*f* is a memory for storing a threshold value for phase interpolation in the start phase interpolation processing of FIG. 10. When the power of the electronic drum sound source device 2 is turned on and immediately after the start phase interpolation processing of FIG. 10 is executed, it is initialized to "0" indicating that the threshold value is not stored. In the start phase interpolation processing, the start phase memory 23*e*1 of the start phase calculation table 23*e* is sorted in descending order, and the value of the start phase memory 23*e*1 that takes the maximum value of the differences between the values of adjacent start phase memories 23*e*1 sorted in descending order is stored in the phase interpolation threshold memory 23*f* (S42 of FIG. 10). Then, a value equal to or greater than the value of the phase interpolation threshold value memory 23*f* in the start phase memory 23*e*1 of the start phase calculation table 23*e* is subtracted by 2*n* (S43 of FIG. 10).

In the present embodiment, a weighting operation is performed on the values of the start phase memory 23*e*1 of the start phase calculation table 23*e* with the values of the weighting coefficient memory 23*e*2, and then the respective values are added and stored in the start phase data 23*d*4 of the corresponding frequency of the weighted waveform table 23*d*. When the difference between the values of the start phase memory 23*e*1 is large, for example, in the value of a certain start phase data 23*d*4, when No. 1 is "⅛π," No. 2 is "¼π," No. 3 is "3/2π," and No. 4 is "15/8π," the value of the phase difference between No. 2 and No. 3 is "5/4π" but the angular difference is "¾π." This is because the phase is a value that periodically repeats in the range of 0 to 2π, so that the difference value of the phase does not become the angular difference as it is. Depending on the value of the start phase, when interpolation of the start phase is performed using a weighting operation without changing the value of the start phase, it becomes a start phase on a side opposite to the expected start phase, thereby causing a discomfort on hearing sense. Therefore, the value of the start phase memory 23*e*1 which takes the maximum value of the difference between the values of the adjacent start phase memories 23*e*1 sorted in descending order is stored in the phase interpolation threshold memory 23*f*, and is subtracted by 2*n* from the value of the start phase memory 23*e*1 equal to or greater than the value of the phase interpolation threshold memory 23*f*. In the above example, the maximum value of the differences between the values of the adjacent start phase data 23*d*4 in No. 1 to No. 4 is "5/4π" between No. 2 and No. 3. Therefore, 2π is subtracted from No. 3 and No. 4 to be "−½π" and "−⅛π." As a result, since the difference value of the start phase and the angular difference become equal, the interpolation of the start phase using the weighting operation also accords with the angular difference so that a discomfort on hearing sense can be reduced.

Returning to FIG. 6, the external input/output terminal 24 is an interface for transmitting and receiving data between the electronic drum sound source device 2 and the PC 4. The waveform table 41*c* of the PC 4 is received via the external input/output terminal 24 and stored in the waveform table 22*a*. Also, as with the external input/output terminal 48 of the PC 4, data may be transmitted and received by a network connection via a LAN (not shown), or data may be transmitted and received via the Internet, instead of the external input/output terminal 24.

The electronic drum pad 3 is an electronic percussion instrument that transmits beating signals corresponding to hits on the struck surface 30 by the user to the electronic drum sound source device 2. The electronic drum pad 3 has the struck surface 30 for receiving hitting of the user (see FIG. 1(*a*)). The struck sensor 31 is a piezoelectric sensor disposed under the struck surface 30 for detecting the hitting. When the struck surface 30 is hit by the user, the struck sensor 31 detects the vibration caused by the hitting and transmits the strength of the vibration (that is, the result of detection) to the CPU 20. The CPU 20 triggers interruption processing upon reception of the strength of the vibration from the struck sensor 31 and executes the beating detection processing of FIG. 8 during the interruption processing.

The sound source 25 is a device for controlling a tone color of a musical sound and various effects in accordance with instructions from the CPU 20. The sound source 25 incorporates a digital signal processor (DSP) 25*a* that performs envelope processing of musical sounds and arithmetic processing of filters, effects and the like. Also, the sound source 25 is provided with six sine wave generators that generate sine waves with specified frequencies and amplitudes. The sound source 25 performs tone color control using the waveform obtained by performing weighting operation on the waveform memory 23*c*1 stored in the selected waveform table 23*c* in the weighting coefficient memory 23*c*2. At this time, the waveform based on the pitch envelope data, the amplitude envelope data, and the start phase of the standard waveform tables SW1 to SW9 of the waveform memory 23*c*1 are output as sine waves by the sine wave generator. Then, the waveforms of the residual waveform data RW1 to RW9 and these sine waves are mixed, and the digital musical sound signals thereof are converted into analog musical sound signals by a D/A converter (not shown) and are output to the amplifier 26.

The amplifier 26 amplifies the analog musical sound signals output from the sound source 25 and outputs the amplified analog musical sound signals to the speaker 27. The speaker 27 generates (outputs) the analog musical sound signals amplified by the amplifier 26 as musical sounds.

Figure 9A:
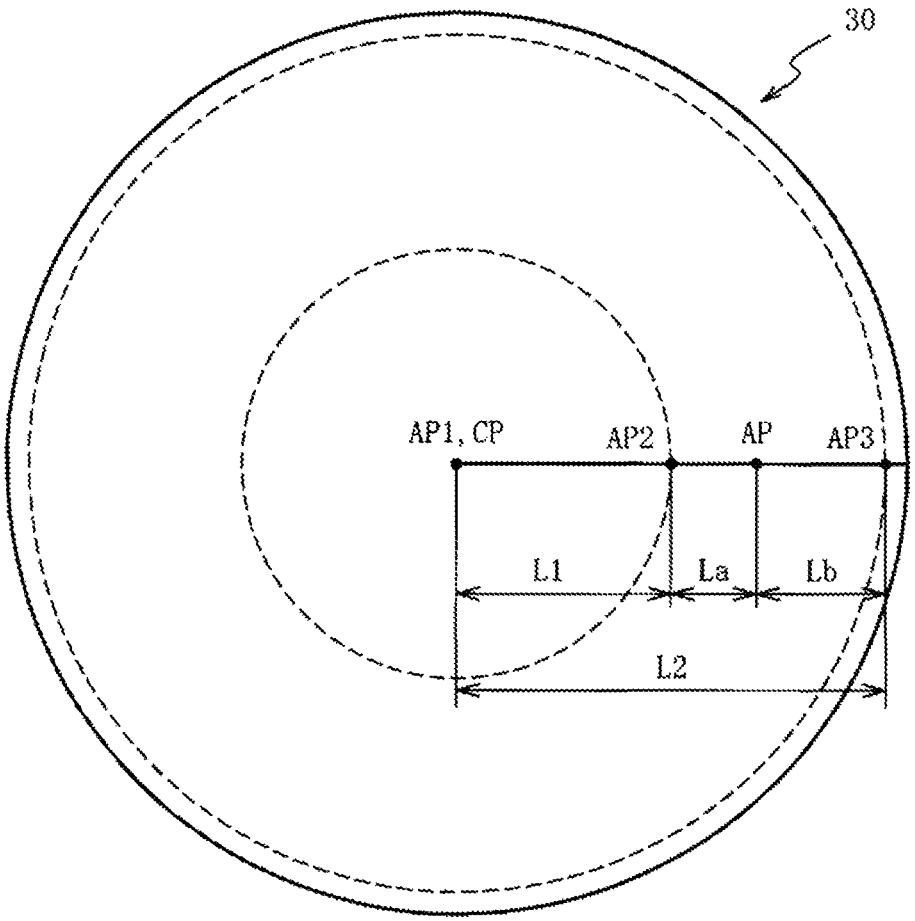
FIG. 9(*a*) is a diagram showing hitting point positions on a struck surface of the electronic drum, and FIG. 9(*b*) is a diagram showing velocity intensity.
Figure 9B:
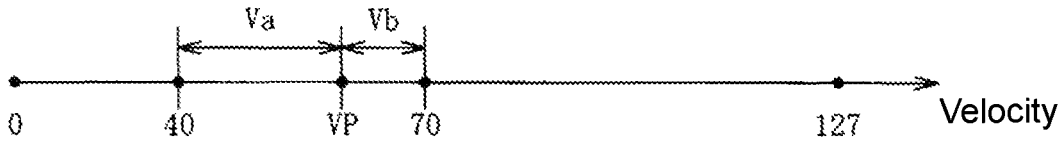

Next, beating detection processing and start phase interpolation processing executed by the CPU 20 of the electronic drum sound source device 2 will be described with reference to FIGS. 8 to 10. FIG. 8 is a flowchart of the beating detection processing. When the struck sensor 31 detects that the struck surface 30 of the electronic drum pad 3 is hit, the beating detection processing detects the velocity and hitting point position from the output value of the struck sensor 31, acquires waveform information approximating to the velocity and hitting point position from the waveform table 22*a*, and performs weighting operation on the waveform information to generate sounds. The beating detection processing is executed by the interruption processing triggered by the struck sensor 31 detecting the hitting.

First, the hitting point position and the velocity are detected from the output value of the struck sensor 31 and are stored in the velocity memory 23*a* and the hitting point position memory 23*b* (S20). Specifically, the waveform of the output value of the struck sensor 31 is analyzed, and the velocity (hitting strength) and the hitting point position (the distance from the center of the struck surface 30) are detected and stored in the velocity memory 23*a* and the hitting point position memory 23*b*, respectively.

After the processing of S20, the waveform information approximating to the value of the velocity memory 23*a* and the value of the hitting point position memory 23*b* is acquired from the waveform table 22*a* and is stored in the waveform memory 23*c*1 of the selected waveform table 23*c* (S21). A total of four pieces of waveform information in which two sets of velocities of the waveform table 22*a* approximating to the values of the velocity memory 23*a* and two sets of the hitting point positions AP1 to AP3 of the waveform table 22*a* approximating to the values of the hitting point position memory 23$b$ are respectively combined are stored in the waveform memory 23$c$1.

After the processing of S21, the weighting coefficients are calculated from the value of the velocity memory 23$a$ and the value of the hitting point position memory 23$b$ and stored in the weighting coefficient memory 23$c$2 of the selected waveform table 23$c$ (S22). Specifically, in response to all of the waveform information stored in the waveform memory 23$c$1 of the selected waveform table 23$c$, the velocities and hitting point positions AP1 to AP3 corresponding to the waveform information are acquired from the waveform table 22$a$. The weighting coefficients are calculated from the velocities, the hitting point positions AP1 to AP3, the value of the velocity memory 23$a$, and the value of the hitting point position memory 23$b$ and stored in the weighting coefficient memory 23$c$2 of the selected waveform table 23$c$.

Here, the selection of the waveform information corresponding to the hits on the struck surface 30 from the waveform table 22$a$ and the calculation of the weighting coefficients for those waveform information in the processing of S21 and S22 will be described with reference to FIGS. 9($a$) and 9($b$). FIG. 9($a$) is a diagram showing the hitting point positions on the struck surface 30 of the electronic drum pad 3, and FIG. 9($b$) is a diagram showing the velocity intensity. In FIG. 9($a$), the hitting point positions AP1 to AP3 of the struck surface 30 are set beforehand, which correspond to the hitting point positions AP1 to AP3 in the waveform table 22$a$ of FIGS. 7($a$)~7($c$). The hitting point position AP1 is the same position as the center position CP of the struck surface 30, and the distance from the center position CP is "0 mm." The hitting point position AP2 is a position where the distance L1 from the center position CP is "75 mm," and the hitting point position AP3 is a position where the distance L2 from the center position CP is "150 mm." The hitting point positions AP1 to AP3 are positions corresponding to the hitting point positions AP1 to AP3 of the waveform table 22$a$, respectively. Further, in the diagram showing the velocity intensity of FIG. 9($b$), three levels of the velocity "40," "70," and "127" are set in advance, and these correspond to the velocity value of the waveform table 22$a$. The waveform information (that is, combinations of the standard waveform tables SW1 to SW9 and the residual waveform data RW1 to RW9) corresponding to the hitting point positions AP1 to AP3 and velocities "40," "70," and "127" are stored in the waveform table 22$a$.

Taking as an example the case of FIGS. 9($a$) and 9($b$) where the hitting point position AP is hit and the velocity is VP, the selection of the waveform information of the waveform table 22$a$ to be stored in the selected waveform table 23$c$ and the calculation of the weighting coefficients for those waveform information will be described. The hitting point position AP is a hitting point position (struck position) located between the hitting point positions AP2 and AP3, and the distance between hitting point position AP and the hitting point position AP2 is set to La and the distance between the hitting point position AP and the hitting point position AP3 is set to Lb. Also, the velocity VP is a velocity taking a value between the velocities "40" and "70," and the difference in velocity between the velocity VP and the velocity "40" is set to Va and the difference in velocity between the velocity VP and the velocity "70" is set to Vb. The waveform information stored in the waveform memory 23$c$1 of the selected waveform table 23$c$ as a result of hitting with the velocity VP and the hitting point position AP is four, i.e., (SW5, RW5), (SW6, RW6), (SW8, RW8) and (SW9, RW9) in the order from No. 1. Assuming that the weighting coefficients of (SW5, RW5), (SW6, RW6), (SW8, RW8) and (SW9, RW9) are C01, C02, C11 and C12, respectively, the respective weighting coefficients are calculated by the following equations 1 to 4.

[Math. 1]

$$C01 = \frac{Lb}{La + Lb} \cdot \frac{Va}{Va + Vb} \quad \text{(Equation 1)}$$

$$C02 = \frac{La}{La + Lb} \cdot \frac{Va}{Va + Vb} \quad \text{(Equation 2)}$$

$$C11 = \frac{Lb}{La + Lb} \cdot \frac{Vb}{Va + Vb} \quad \text{(Equation 3)}$$

$$C12 = \frac{La}{La + Lb} \cdot \frac{Vb}{Va + Vb} \quad \text{(Equation 4)}$$

The calculated C01, C02, C11 and C12 are stored in the weighting coefficient memory 23$c$2 of the waveform memory 23$c$1. Also, the weighting coefficients may be obtained by converting the values calculated by Equations 1 to 4 in accordance with a plurality of velocities and hitting point positions in advance into a data table and then designating the velocity and the hitting point position with respect to the data table to acquire the weighting coefficients.

Returning to FIGS. 7($a$)~7($c$), after the processing of S22, weighting operation is performed on the waveform information of the selected waveform table 23$c$ and stored in the weighted waveform table (S23). More specifically, the frequencies SW1$a$ to SW9$a$ at the same storage position in the standard waveform tables SW1 to SW9 stored in the waveform memory of the selected waveform table 23$c$ are stored at the frequency 23$d$1 of the weighted waveform table 23$d$. Next, with respect to the pitch envelope data SW1$b$ to SW9$b$ and the amplitude envelope data SW1$c$ to SW9$c$ at the same storage position of the standard waveform tables SW1 to SW9 stored in the waveform memory of the selected waveform table 23$c$, the result multiplied by the value obtained by performing weighting operation with the value of the corresponding weighting coefficient memory 23$c$2 is added. Then, the results of weighting operation are stored in the pitch envelope data 23$d$2 and the amplitude envelope data 23$d$3 of the weighted waveform table 23$d$.

After the processing of S23, the start phase interpolation processing is performed (S24). The start phase interpolation processing will be described with reference to FIG. 10. FIG. 10 is a flowchart of the start phase interpolation processing executed by the electronic drum sound source device 2. In the start phase interpolation processing, the results of performing a weighting operation on the start phases of the same storage positions in the standard waveform tables SW1 to SW9 of the waveform information stored in the selection waveform table 23$c$ are set as the start phase data 23$d$4 of the weighted waveform table 23$d$.

Since the standard waveform tables SW1 to SW9 are generated by individually recorded drum sounds, the start phases of the standard waveform tables SW1 to SW9 are not necessarily all the same. In S24 of FIG. 8 which will be described later, the weighting operation is performed on the pitch envelope and the amplitude envelope for each frequency of the standard waveform tables SW1 to SW9 stored in the waveform memory 23$c$1 of the selected waveform table 23$c$ with the values in the weighting coefficient memory 23$c$2 and then the results are added to generate them as musical sounds.

In FIG. 10, first, n is set to 1 (S40). n is a natural number and is a value indicating the acquisition position of frequencies of the standard waveform tables SW1 to SW9 stored in the waveform memory 23*c*1 of the selected waveform table 23*c*. Hereinafter, "n-th" means "1st" when the value of n is 1, "2nd" when the value of n is 2, . . . , "6th" when the value of n is 6, respectively.

After the processing of S40, the values of the n-th start phase data SW1*d* to SW9*d* and the weighting coefficient memory 23*c*2 of the corresponding selected waveform table 23*c* are acquired from the waveform memory 23*c*1 of the selected waveform table 23*c*, and stored in the start phase calculation table 23*e* in the order of arrangement of the selected waveform table 23*c* (S41). More specifically, the n-th start phase data SW1*d* to SW9*d* are acquired from all the standard waveform tables SW1 to SW9 stored in the waveform memory 23*c*1 of the selected waveform table 23*c*. These values are stored in the same order as the waveform memory 23*c*1 corresponding to the standard waveform tables SW1 to SW9 from which the start phase data SW1*d* to SW9*d* of the start phase memory 23*e*1 of the start phase calculation table 23*e* are acquired. Also, the value stored in the weighting coefficient memory 23*c*2 of the selected waveform table 23*c* is stored in the start phase memory 23*e*1 of the start phase calculation table 23*e* in the order stored in the selected waveform table 23*c*. As described above, the start phase calculation table 23*e* stores the start phase memory 23*e*1 and the weighting coefficient memory 23*e*2 in the same order as the selected waveform table 23*c*.

After the processing of S41, the start phase calculation table 23*e* is sorted in descending order based on the value of the start phase memory 23*e*1, the differences between the values of adjacent start phase memories 23*e*1 are calculated, and the value of the start phase memory 23*e*1 taking the maximum value is stored in the phase interpolation threshold memory 23*f* (S42). After S42, 2π is subtracted from the value of the start phase memory 23*e*1 of the start phase calculation table 23*e* equal to or larger than the value of the phase interpolation threshold value memory 23*f* (S43). Depending on the values of the start phase memory 23*e*1 possibly to be taken, the difference between the values of the start phase memory 23*e*1 increases. Accordingly, if the start phase is calculated through the weighting operation, which will be described later, without a change, it becomes a start phase on a side opposite to the expected start phase, thereby causing a discomfort on hearing sense. Thus, adjustment is made by storing the value of the start phase memory 23*e*1 that takes the maximum value of the differences between the values of the adjacent start phase memories 23*e*1 sorted in descending order in the phase interpolation threshold memory 23*f* and subtracting 2π from the value of the start phase memory 23*e*1 that takes a value greater than the phase interpolation threshold value memory 23*f*. As a result, since the difference value of the start phases is equal to the angle difference, the interpolation of the start phase using the weighting operation also accords with the angle difference so that a discomfort on hearing sense can be reduced.

After the processing of S43, the weighting operation is performed on the value of the start phase memory 23*e*1 of the start phase calculation table 23*e*, and stored at the n-th position in the start phase data 23*d*4 of the weighted waveform table 23*d* (S44). Specifically, the result of multiplying the values of all the start phase memories 23*e*1 stored in the weighted waveform table 23*d* by the values of the weighting coefficient memory 23*e*2 is added. The addition result is set as the start phase at the n-th position and stored in the n-th position in the start phase data 23*d*4 of the weighted waveform table 23*d*. Also, when the addition result is a negative value, a value obtained by further adding 2π is stored in the n-th position in the start phase data 23*d*4 of the weighted waveform table 23*d*.

After the processing of S44, 1 is added to n (S45) to prepare for the processing of S40 to S44 for the next frequency. After the processing of S45, it is checked whether or not n is larger than 6 (S46). In the present embodiment, since the number of data stored in the standard waveform tables SW1 to SW9 is six, it is checked whether or not n is larger than the upper limit of "6." When n is 6 or less (S46: No), the process returns to S40. On the other hand, if n is larger than 6 (S46: Yes), the start phase interpolation processing is terminated and the process returns to the beating detection processing (FIG. 8).

Returning to FIG. 8, after the start phase interpolation processing of S24, all the sine waves based on the pitch envelope data wP1 to wP6 and the amplitude envelope data wA1 to wA6 in the initial acquisition position of the weighted waveform table 23*d* and the results of performing a weighting operation on the total residual waveforms are mixed and a sound generation is started (S25). Specifically, first, the frequencies of the frequency 23*d*1 of the weighted waveform table 23*d* are set to the sine wave generator of the sound source 25. Then, the pitch data P12 and the amplitude level data A12 corresponding to the initial acquisition position of the pitch envelope data wP1 to wP6 and amplitude envelope data wA1 to wA6, that is, the top position in FIGS. 3(*b*) and 3(*c*) are acquired. The values of the obtained pitch data P12 and amplitude level data A12 of each frequency are set in the sine wave generator and sine waves are generated at the phases of the start phase data 23*d*4 of the weighted waveform table 23*d*. Also, the amplitude of the waveform of the residual waveform data RW1 to RW9 stored in the waveform memory 23*c*1 of the selected waveform table 23*c* is multiplied by the weighting coefficient memory 23*c*2 corresponding to the position of the waveform memory 23*c*1 and the resultant waveform is added.

Then, these sine waves (that is, sine wave components) and the waveform obtained by performing a weighting operation on the residual waveform data RW1 to RW9 (that is, residual components) are mixed by the sound source 25 to generate musical sounds (sounds of a percussion instrument). In this manner, by selecting the waveform information in accordance with the velocity and the hitting point position onto the electronic drum pad 3 and performing a weighting operation on the waveform information, it is possible to generate musical sounds approximating to the velocity and hitting point position. In addition, since the start phase for each frequency uses the value of the start phase data 23*d*4 of the weighted waveform table 23*d* calculated in advance, phase interference due to the start phases disappears. Thus, since the "sound thinning" occurring, for example, in the case of reverse phase can be suppressed, it is possible to reproduce a drum sound with less discomfort on hearing sense. Also, the "sound thinning" may occur because the waveforms obtained by performing a weighting operation on the residual waveform data RW1 to RW9 are added as they are (that is, the cross-fade processing). However, the residual waveform data RW1 to RW9 are waveforms of frequency components other than the "noticeable" standard waveform tables SW1 to SW9. Thus, even if the "sound thinning" occurs, it is not so much as to cause a discomfort on hearing sense.

After the processing of S25, n is set to 1 (S26). n is a natural number and is a value indicating the acquisition position of the weighted waveform table 23*d*. After the processing of S26, it is checked whether or not the update time of the pitch envelope or the amplitude envelope has elapsed (S27). Specifically, in the pitch envelope data 23*d*2 and/or the amplitude envelope data 23*d*3 of the n-th weighted waveform table 23*d*, it is checked whether or not the time until the pitch data P12 and the amplitude level data A12 (FIGS. 3(*b*) and 3*c*)) have been updated since the musical sound was generated, that is, the time P11 and/or the time A11 have elapsed. Also, whether or not the time P11 and/or the time A11 has elapsed since the musical sound was generated is determined by interval interrupt processing (not shown) periodically executed (for example, every 1 ms).

When the update time of the pitch envelope or the amplitude envelope has elapsed (S27: Yes), the acquisition position of the pitch envelope data 23*d*2 and/or the amplitude envelope data 23*d*3 of the n-th weighted waveform table 23*d* is advanced by one, and the pitch data P12 and/or amplitude level data A12 are acquired (S28).

After the processing of S28, the sine wave generator of the DSP 25*a* which generates the sine wave corresponding to the n-th weighted waveform table 23*d* generates sounds such that the pitch/amplitude set at the present time is changed to the pitch data P12 and/or amplitude level data A12 acquired by the next update time (S29). Specifically, the value of the pitch and/or the amplitude set in the sine wave generator that generates the sine wave corresponding to the n-th weighted waveform table 23*d* is acquired. The sound generation is performed while the pitch and/or the amplitude of the sine wave generator is changed such that the value of the pitch and/or the amplitude is smoothly changed to the pitch data P12 and/or the amplitude level data A12 acquired in S28 until the time P11 and/or the time A11 in the next update time (that is, FIGS. 3(*b*) and 3(*c*)). These are executed by processing for each sample by the DSP 25*a*.

An example is shown in the pitch envelope data P1 in FIG. 3(*b*). It is assumed that 5 ms has elapsed from the start of sounding of S25. At this time, a pitch of −20 cent is set in the corresponding sine wave generator. In the processing of S28, "+8 cent" which is the pitch data P12 at the next update time, that is, 20 ms is acquired. Then, in the processing of S29, the pitch of the sine wave generator is changed to smoothly rise from the set value of −20 cent to +8 cent before the next update time (20 ms). Also, as for the amplitude envelope, the amplitude set in the sine wave generator is changed in the same way as the pitch envelope. As a result, a temporal change in the pitch and/or the amplitude of the sine wave corresponding to the n-th weighted waveform table 23*d* during sounding is realized.

When the update time of the pitch envelope or the amplitude envelope has not elapsed (S27: No) in the processing of S27, the processing of S28 and S29 is skipped. After the processing of S27 and S29, it is checked whether or not n is 6 or more (S30). Since the number of data stored in the weighted waveform table 23*d* is 6, it is checked whether or not n is "6" or more, which is the upper limit thereof. When n is smaller than 6 (S30: No), 1 is added to n (S31), and the processing of S27 is performed. On the other hand, if n is 6 or more (S30: Yes), it is checked whether or not 3 seconds have elapsed since the musical sound generation started (S32). Since the lengths of the pitch data P12 and the amplitude level data A12 stored in the pitch envelope data 23*d*2 and the amplitude envelope data 23*d*3 of the weighted waveform table 23*d* are 3 seconds, it is checked whether or not 3 seconds have elapsed since the generation of the musical sounds was started in the processing of S25. Whether or not three seconds have elapsed since the musical sound was generated is determined by interval interrupt processing (not shown) periodically executed (for example, every 1 ms).

In the processing of S32, if 3 seconds have not elapsed since the musical sound generation started (S32: No), the processing of S26 is performed. On the other hand, if three seconds have elapsed since the musical sound generation started (S32: Yes) in the processing of S32, the sound generation is stopped (S33). Specifically, the sounding of all the sine waves by the sine wave generator and the sound generation of the all residual waveforms started by the processing of S25 are stopped. After the processing of S33, the beating detection processing is terminated.

As described above, the electronic drum 1 in the present embodiment acquires four pieces of waveform information approximating to the value of the velocity memory 23*a* and the value of the hitting point position memory 23*b* due to the hits on the electronic drum pad 3 from the waveform table 22*a*, and stores them in the waveform memory 23*c*1 of the waveform table 23*c*. This waveform information is configured by combinations of standard waveform tables SW1 to SW9 each of which includes the pitch envelope, the amplitude envelope, and the start phase for each frequency in the "noticeable" frequency band from the waveform data 41*b* recorded from the prescribed velocity and hitting point position of the drum, and the residual waveform data RW1 to RW9 which have frequency components from which the "noticeable" frequency band has been removed.

The results of multiplying the values of the weighting coefficient memory 23*c*2 corresponding to the waveform memory 23*c*1 of the selected waveform table 23*c* to the values of the pitch envelope data P1 to P6 and the amplitude envelope data A1 to A6 are added to the standard waveform tables SW1 to SW9 of the waveform information stored in the waveform memory 23*c*1 of the selected waveform table 23*c*. The result of performing a weighting operation on the start phase of the same frequency in the standard waveform tables SW1 to SW9 stored in the waveform memory 23*c*1 with respect to the addition result is set to be a start phase, thereby obtaining a sine wave. Then, the result of multiplying the value of the weighting coefficient memory 23*c*2 corresponding to the waveform memory 23*c*1 of each selected waveform table 23*c* with respect to the amplitude of the residual waveform data RW1 to RW9 of the waveform information stored in the waveform memory 23*c*1 is added. The sine wave obtained by these and the waveforms of the residual waveform data RW1 to RW9 are input to the sound source 25, and mixed by the sound source 25 to generate sounds as musical sounds. Therefore, the sine wave and the waveform of the residual waveform data RW1 to RW9 are synthesized but two or more pieces of waveform data are not synthesized, whereby the "sound thinning" due to phase interference can be prevented. That is, it is possible to reproduce consistent musical sounds with no phase interference.

Also, a weighting operation of the waveform information stored in the waveform memory 23*c*1 of the selected waveform table 23*c* is performed in accordance with the velocity VP and the hitting point position AP (beating conditions) by hitting the electronic drum pad 3. That is, by continuously changing the pitch envelope data SW1*b* to SW9*b* and the amplitude envelope data SW1*c* to SW9*c* according to the beating conditions, it is possible to realize a smooth change in sound volume and tone color in accordance with a change in beating conditions as with the actual drum.

Furthermore, since the sine wave generated by the weighting operation is generated based on the pitch envelope data SW1*b* to SW9*b* and the amplitude envelope data SW1*c* to SW9*c* of the waveform information stored in the waveform memory 23*c*1, it is possible to suitably reproduce musical sounds of a drum having a large temporal change in frequency. In the waveform table 22*a*, since the pitch envelope data SW1*b* to SW9*b* and the amplitude envelope data SW1*c* to SW9*c* which are elements constituting sounds of a percussion instrument are stored by being differentiated from each other, tone color editing can be easily performed.

In addition to the pitch envelope data 23*d*2 and the amplitude envelope data 23*d*3, since the weighted waveform table 23*d* further stores start phase data and a sine wave is generated based on the start phase data 23*d*4, sounds of a percussion instrument with even better quality can be reproduced.

Although the present invention has been described based on the embodiments, it should be appreciated that the present invention is not limited to the above-described embodiments and various improvements and modifications are possible within the scope not deviating from the gist of the present invention.

In the present embodiment, the electronic drum 1 has been described as an example of the electronic percussion instrument. However, the present invention is not limited to this, and may be applied to simulation of other percussion instruments such as bass drums, snares, toms, cymbals, and the like.

In the present embodiment, the electronic drum 1 is configured by including the electronic drum sound source device 2 and the electronic drum pad 3 as separate devices. However, the present invention is not limited to this, and the electronic drum 1 may be configured such that the electronic drum sound source device 2 is built in the electronic drum pad 3.

In the present embodiment, six frequency frequencies with large amplitudes of the values of the spectrum memory 42*a* are extracted for the "noticeable" frequency band. However, the present invention is not limited to this, and a predetermined number (for example, six) of frequency bands whose amplitude of the value of the spectrum memory 42*a* is equal to or larger than a predetermined value (for example, −55 dB) may be extracted as the "noticeable" frequency band. In addition, six frequency bands in which the amplitude difference between the "mountain top" in the spectrum memory 42*a* and the "valley bottoms" before and after the "mountain top" is large may be extracted as the "noticeable" frequency band.

Further, six characteristic frequency bands may be extracted as the "noticeable" frequency band from waveform data for each velocity and each hitting point position in the waveform data 41*b*. Specifically, in the case where "musical sound characteristics" of waveform data at a certain velocity and hitting point position disappear by removing a certain frequency band from the waveform data at the velocity and hitting point position, the frequency band is set to be the "noticeable" frequency band.

In the present embodiment, although the number of frequencies to be extracted as the "noticeable" frequency bands is six, it may be six or more or six or less depending on the number of the sine wave generators provided in the sound source 25, the characteristics of the simulated sounds of a percussion instrument, and the like. In that case, the number of data stored in the standard waveform tables SW1 to SW9 and the weighted waveform table 23*d* may be set as the number of frequencies to be extracted, and the number to be compared with "n" in the processing of S10 of the standard waveform generation processing of FIG. 4, the processing of S30 of the beating detection processing of FIG. 8, and the processing of S46 of the start phase interpolation processing of FIG. 10 may be the same as the number of frequencies to be extracted.

In the present embodiment, the center frequency of the "noticeable" frequency band is acquired by analyzing the waveform data of the velocity "127" and the hitting point position "0 mm" in the standard waveform generation processing of FIG. 4. However, the present invention is not limited to this, and it is also possible to analyze the waveform data of other velocities and hitting point positions (for example, waveform data of velocity "70" and hitting point position "75 mm") to acquire the center frequency of the "noticeable" frequency band.

In addition, the waveform data 41*b* of all velocities and hitting points may be analyzed beforehand and the center frequency of the "noticeable" frequency band is acquired from the waveform data 41*b* of each velocity and hit position, and then the pitch envelope, the amplitude envelope, and the start phase for these frequencies may be calculated from the waveform data 41*b* of each velocity and hitting point position.

In the present embodiment, the lengths of the pitch envelope data SW1*b* to SW9*b* of the standard waveform tables SW1 to SW9 and the lengths of the amplitude envelope data SW1*c* to SW9*c* are set to 3 seconds. However, it is not necessarily limited to this, but it may be 3 seconds or more or 3 seconds or less depending on characteristics such as the length of the musical sounds of the simulated percussion instrument.

In the present embodiment, waveforms obtained by inverse discrete Fourier transformation of the residual spectrum memory 42*c* including frequency components other than those stored in the standard waveform tables SW1 to SW9 from the spectrum memory 42*a* are stored in the residual waveform data RW1 to RW9. However, the present invention is not limited to this, and waveforms obtained by subtracting sine waves based on the standard waveform tables SW1 to SW9 from the waveforms of the waveform data 41*b* may be stored in the residual waveform data RW1 to RW9 as the residual waveform. In this case, since it is unnecessary to perform inverse discrete Fourier transformation on the residual spectrum memory 42*c* and there is no calculation error due to the inverse discrete Fourier transformation, the residual waveform data more faithful to the waveform data 41*b* can be stored in the residual waveform data RW1 to RW9.

In the present embodiment, it is assumed that four pieces of waveform information are stored in the selected waveform table 23*c*, depending on the velocity and the hitting point position onto the struck surface 30. However, the present invention is not limited to this, and the number of pieces of waveform information stored in the selected waveform table 23*c* may be two or three or more. In that case, the size of the selected waveform table 23*c* and the start phase calculation table 23*e* may be set to a size that matches the number of pieces of waveform information to be stored.

In the present embodiment, the amplitude of the waveform of the residual waveform data RW1 to RW9 stored in the waveform memory 23*c*1 of the selected waveform table 23*c* is multiplied by the weighting coefficient memory 23*c*2 corresponding to the position of the waveform memory 23*c*1 and the resultant waveforms are added to generate sounds. However, the present invention is not limited to this, and for example, one of the residual waveform data RW1 to RW9 stored in the waveform memory 23*c*1 of the selected waveform table 23*c* may be sounded without performing a weighting operation on the residual waveform data RW1 to RW9.

In the present embodiment, nine pieces of waveform information are stored in the waveform table 22*a*. However, the present invention is not limited to this, and the waveform information stored in the waveform table 22*a* may be nine or more, or nine or less. In that case, the size of the waveform tables 41*c* and 22*a* and the number to be compared with "m" in the processing of S13 of the standard waveform creation process of FIG. 4 may be changed in accordance with the number of pieces of waveform information to be stored.

What is claimed is:

1. A sound source of an electronic percussion instrument comprising a struck surface and a struck sensor for detecting hits on the struck surface, comprising:

a waveform data storage means which stores waveform data of musical sounds in different beating conditions; and a sound generation control means which generates musical sounds by using the waveform data stored in the waveform data storage means in accordance with results of detection by the struck sensor, wherein the waveform data storage means comprises two or more pieces of waveform data in different beating conditions, with respect to each beating condition, one of the pieces of the waveform data comprises pitch envelope data and amplitude envelope data for one or a plurality of sine wave components separated from an original waveform of a musical sound, and a residual component of the original waveform from which the one or the plurality of sine wave components are separated, and the sound generation control means generates a sine wave component based on the pitch envelope data and the amplitude envelope data of the two or more pieces of waveform data stored in the waveform data storage means in accordance with detection results of the struck sensor and synthesizes the sine wave component with the residual component to generate musical sounds.

2. The sound source of the electronic percussion instrument according to claim 1, wherein the sound generation control means performs a weighting operation on the two or more pieces of waveform data stored in the waveform data storage means in accordance with the detection results of the struck sensor, generates the sine wave component based on the pitch envelope data and the amplitude envelope data, and synthesizes the sine wave component with the residual component to generate musical sounds.

3. The sound source of the electronic percussion instrument according to claim 1, wherein the sound generation control means performs a weighting operation on the two or more pieces of waveform data stored in the waveform data storage means in accordance with the detection results of the struck sensor, generates the sine wave component based on the pitch envelope data and the amplitude envelope data, and synthesizes the sine wave component with the residual component obtained by performing a weighting operation thereon to generate musical sounds.

4. The sound source of the electronic percussion instrument according to claim 1, wherein, with respect to each beating condition, the one piece of waveform data stored in the waveform data storage means further comprises start phase data for one or a plurality of sine wave components separated from the original waveform of the musical sound, and the sound generation control means generates the sine wave component based on the pitch envelope data, the amplitude envelope data and the start phase data, and synthesizes the sine wave component with the residual component to generate musical sounds.

5. The sound source of the electronic percussion instrument according to claim 4, wherein the sound generation control means comprises an adjustment means which adjusts a difference value and an angular difference of the start phase data in the two or more pieces of waveform data on which a weighting operation is performed in accordance with the results of detection by the struck sensor.

6. The sound source of the electronic percussion instrument according to claim 5, wherein, with respect to adjacent waveform data sorted in descending or ascending order of amplitude of the start phase data in the two or more pieces of waveform data on which the weighting operation is performed in accordance with the results of detection by the struck sensor, the adjustment means adjusts the difference value and the angular difference of the start phase data by subtracting $2\pi$ from the start phase data for the waveform data having a largest difference in the start phase data and the waveform data having a start phase data larger than the waveform data having the largest difference in the start phase data.

7. The sound source of the electronic percussion instrument according to claim 1, wherein the one or a plurality of sine wave components separated from the original waveform of the musical sound are sine wave components having amplitudes equal to or greater than a predetermined value or sine wave components from a largest to an n-th sine wave components in descending order of amplitude, the n is a natural number.

8. The sound source of the electronic percussion instrument according to claim 1, wherein the residual component is obtained by subtracting the one or plurality of sine wave components from the original waveform of the musical sound.

9. The sound source of the electronic percussion instrument according to claim 1, wherein the beating condition is a hit strength detected by the struck sensor.

10. The sound source of the electronic percussion instrument according to claim 1, wherein the beating condition is a struck position on the struck surface detected by the struck sensor.

11. A sound production control method for detecting hits on a struck surface of an electronic percussion instrument and performing sound production control on a musical sound according to detecting result of the hits, the method comprises:

storing two or more pieces of waveform data of musical sounds recorded from an percussion in different beating conditions, wherein with respect to each beating condition, one of the pieces of the stored waveform data comprises pitch envelope data and amplitude envelope data for one or a plurality of sine wave components separated from an original waveform of the recorded musical sound, and a residual component of the original waveform from which the one or the plurality of sine wave components are separated;

generating a sine wave component based on the pitch envelope data and the amplitude envelope data of the two or more pieces of stored waveform data in accordance with detection results of the hit; and synthesizing the generated sine wave component with the residual component to generate musical sounds.

12. The method according to claim 11, wherein the generated sine wave component is generated by performing a weighting operation on the two or more pieces of stored waveform data in accordance with the detection results of the hit and based on the pitch envelope data and the amplitude envelope data, wherein the generated musical sounds are generated by synthesizing the generated sine wave component with the residual component.

13. The method according to claim 11, wherein the generated sine wave component is generated by performing a weighting operation on the two or more pieces of stored waveform data in accordance with the detection results of the hit and based on the pitch envelope data and the amplitude envelope data, wherein the generated musical sounds are generated by synthesizing the generated sine wave component with the residual component obtained in the weighting operation.

14. The method according to claim 11, wherein, with respect to each beating condition, the one piece of stored waveform data further comprises start phase data for one or a plurality of sine wave components separated from the original waveform of the recorded musical sounds, and the generated sine wave component is generated based on the pitch envelope data, the amplitude envelope data and the start phase data, and the generated musical sounds are generated by synthesizing the generated sine wave component with the residual component.

15. The method according to claim 14, further comprising:

adjusting a difference value and an angular difference of the start phase data in the two or more pieces of waveform data on which a weighting operation is performed in accordance with the results of the hit.

16. The method according to claim 15, wherein the adjusting of the difference value and the angular difference of the start phase data in the two or more pieces of waveform data on which a weighting operation is performed is:

with respect to adjacent waveform data sorted in descending or ascending order of amplitude of the start phase data, adjusting the difference value and the angular difference of the start phase data by subtracting $2\pi$ from the start phase data for the waveform data having a largest difference in the start phase data and the waveform data having a start phase data larger than the waveform data having the largest difference in the start phase data.

17. The method according to claim 11, wherein the one or a plurality of stored sine wave components separated from the original waveform of the recorded musical sound are sine wave components having amplitudes equal to or greater than a predetermined value or sine wave components from a largest to an n-th sine wave components in descending order of amplitude, the n is a natural number.

18. The method according to claim 11, wherein the residual component is obtained by subtracting the one or plurality of sine wave components from the original waveform of the recorded musical sound.

19. The method according to claim 11, wherein the beating condition is a hit strength on the struck surface.

20. The method according to claim 11, wherein the beating condition is a struck position on the struck surface.

* * * * *